US009539815B2

(12) United States Patent
Martin et al.

(10) Patent No.: US 9,539,815 B2
(45) Date of Patent: Jan. 10, 2017

(54) LOW-PROFILE SERVICE STATIONS FOR USE WITH PRINTERS

(75) Inventors: Scott Martin, Vancouver, WA (US); Lynn A. Collie, Battle Ground, WA (US); Eric Berner Strom, Canby, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 935 days.

(21) Appl. No.: 13/164,267

(22) Filed: Jun. 20, 2011

(65) Prior Publication Data

US 2012/0320126 A1 Dec. 20, 2012

(51) Int. Cl.
*B41J 2/165* (2006.01)

(52) U.S. Cl.
CPC ..... *B41J 2/165* (2013.01)

(58) Field of Classification Search
None
See application file for complete search history.

(56) References Cited

U.S. PATENT DOCUMENTS

| | | | | |
|---|---|---|---|---|
| 6,276,852 | B1 | 8/2001 | Osmus | |
| 6,280,015 | B1 | 8/2001 | Nguyen et al. | |
| 6,540,320 | B2 | 4/2003 | Ng | |
| 7,748,807 | B2 | 7/2010 | Jones et al. | |
| 2002/0015076 | A1* | 2/2002 | Uchikata et al. | 347/50 |
| 2005/0219309 | A1* | 10/2005 | Uchida | 347/30 |
| 2008/0180481 | A1 | 7/2008 | Elenes et al. | |
| 2009/0174748 | A1* | 7/2009 | Balcan et al. | 347/32 |
| 2010/0253738 | A1 | 10/2010 | Jariabka et al. | |

* cited by examiner

*Primary Examiner* — Alejandro Valencia
(74) *Attorney, Agent, or Firm* — HP Inc. Patent Department

(57) ABSTRACT

Low-profile service stations for use with printers are described herein. One example service station includes a shuttle to support a cap sled. The shuttle has a shuttle drive and a pump drive positioned such that at least one of the shuttle drive and the pump drive does not extend between a first side and a second side of the shuttle. The shuttle drive is coupled to a printer drive to move the shuttle between a first position and a second position.

34 Claims, 15 Drawing Sheets

LOW-PROFILE SERVICE STATIONS FOR USE WITH PRINTERS

BACKGROUND

Printing systems such as ink jet printers employ a printhead having print nozzles to expel fluid droplets onto print media, which dry to form images. The print nozzles may become clogged with ink or particulates and are prone to clogging or other performance-deteriorating problems, resulting in inefficient operation of the printhead and reduced print quality. To maintain or clean the print heads, a printer often employs a service station to provide one or more servicing procedures, including spitting, wiping, capping, priming and/or purging. However, conventional service stations often employ a relatively complex drive system, which can significantly increase the cost of the printer. Further, conventional service stations often have a relatively large platform or dimensional envelope that causes of a printer to have a relatively large profile.

BRIEF DESCRIPTION OF THE DRAWINGS

Where ever possible the same reference numbers will be used throughout the drawing(s) and accompanying written description to refer to the same or like parts.

DETAILED DESCRIPTION

Figure 1:
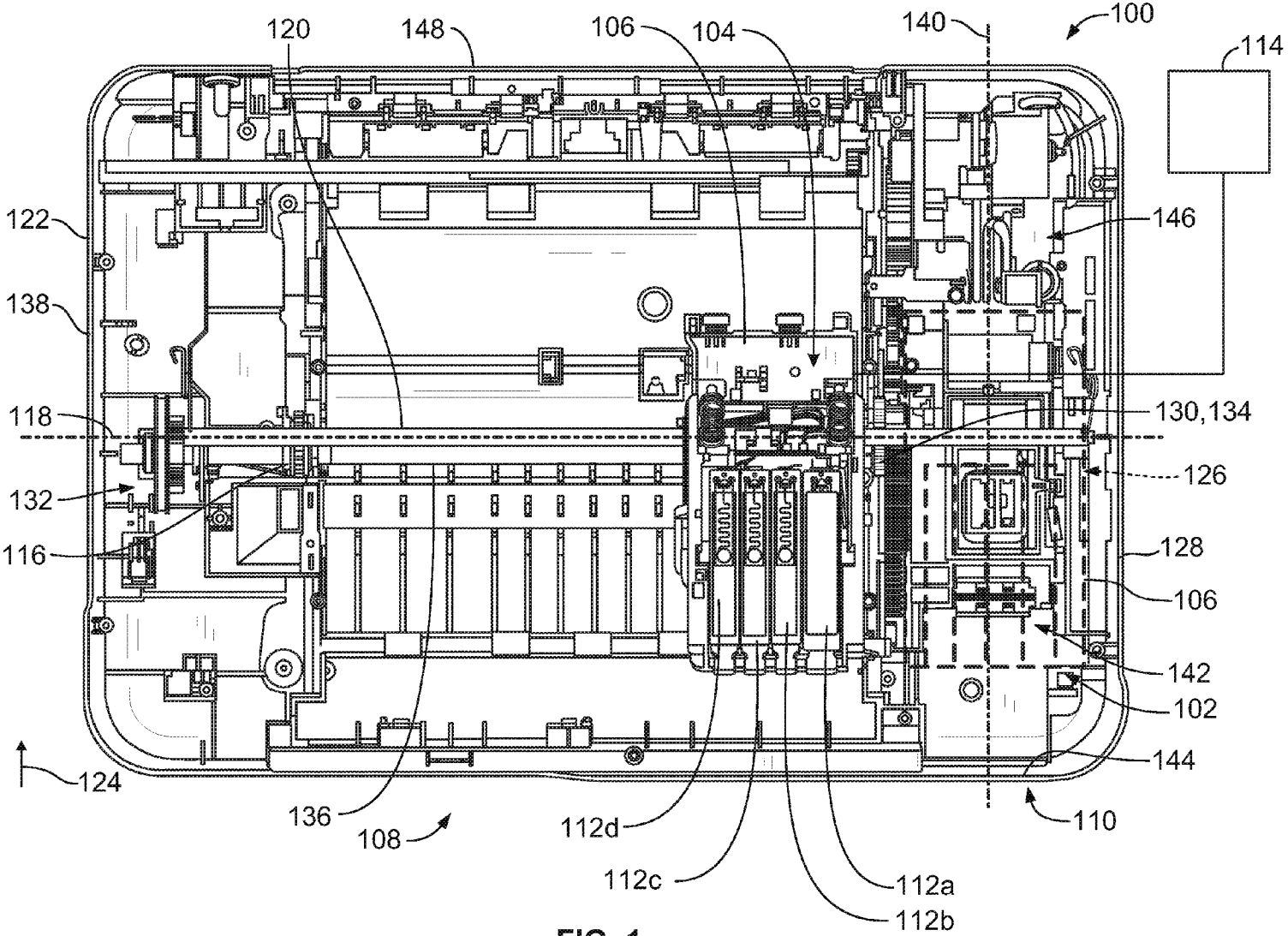
FIG. 1 is a partial plan view of an example printer having a service station in accordance with the teachings described herein.

Certain examples are shown in the above-identified figures and described in detail below. The figures are not necessarily to scale and certain features and certain views of the figures may be shown exaggerated in scale or in schematic for clarity and/or conciseness. Additionally, some components of the example service station apparatus described herein have been removed from some of the drawing(s) for clarity. Although the following discloses example methods and apparatus, it should be noted that such methods and apparatus are merely illustrative and should not be considered as limiting the scope of this disclosure. Further, although the illustrated examples described in the figures illustrate a service station system for use with on-axis fluid ejection systems or printing systems (e.g., ink jet printing systems), the example service station systems described herein may also be employed with off-axis fluid ejection systems.

As used herein, directional terms, such as "top," "bottom," "front," "back," "leading," "trailing," etc. are used with reference to the orientation of the figures being described. Because components of various embodiments disclosed herein can be positioned in a number of different orientations, the directional terminology is used for illustrative purposes only and is not intended to be limiting.

Fluid ejection systems such as, for example, ink jet printers employ a fluid delivery system that includes a printhead mechanism that expels fluid droplets onto a print media. A fluid supply cartridge may be permanently or removably attached to a printhead mechanism (e.g., "on-axis" printing), or fluidly coupled to a separate, self-contained fluid supply reservoir that is remote from the printhead mechanism (e.g., "off-axis" printing). Such printhead mechanisms are susceptible to clogging, becoming contaminated, or drying out, which can affect the print quality.

To service or maintain printhead mechanisms, printers often employ service stations. For example, to prevent print nozzles of a printhead mechanism from drying out during periods of non-use, service stations often include a capping mechanism configured to receive the printhead mechanism. To prevent the nozzles from drying out, the capping mechanism includes a cover and/or a seal that surrounds or encircles the print nozzles of the printhead mechanism. Also, to purge fluid (e.g., ink or air) from the print nozzles, some known service stations provide a priming function.

However, conventional service stations often employ a relatively complex drive system, which can significantly increase the cost of a printer. More specifically, conventional service stations often employ a drive system that spans underneath and across a service station area. For example, conventional services stations may employ a shuttle drive and a pump drive extending between a first side of the service station and a second side of the service station opposite the first side. As a result, the shuttle and pump drive increase the product height dimension of the printer mechanism and increase the number of components and, thus, manufacturing costs.

Further, conventional service stations often employ a pump that is disposed underneath a cap sled of the service station, thereby increasing the overall height of the printer. Such a pump position is employed because conventional service stations typically use carriage interference to activate the pump. Because the cap sled of conventional service stations is positioned directly under the printhead and the pump is positioned directly under the cap sled, conventional service stations typically dictate the overall dimensional height of the printer, which often results in the printer having a relatively large footprint, dimensional envelope and/or profile. Thus, conventional service stations that employ pumps in the foregoing manner are not conducive to size optimization because the pump is bulky and is positioned underneath the travel of the cap sled. As a result, many conventional service stations may not be suitable for use with applications having space limitations or constraints.

Additionally, to capture both serviced ink and primed ink (from priming), conventional service stations often include an intricate array of prime absorbers (e.g., absorber pads) located beneath the cap sled adjacent the pump and the shuttle drive. The absorbers are typically located within substantially the same space as the pump and shuttle drive mechanisms. As a result, the absorbers and/or the service station housing or shuttle often have complex geometries (e.g., cut-out portions) that significantly increase manufacturing costs.

Example methods, systems and apparatus described herein overcome at least the foregoing problems and provide an improved low-profile and/or cost-effective service station that may be used with a fluid ejection system. In particular, example service stations described herein provide a low-profile service station that enables implementation of a low-cost, low-profile printer.

Unlike conventional service stations, the example service station apparatus described herein employ a shuttle drive (e.g., a linear actuator) and a pump drive positioned such that at least one of the shuttle drive and the pump drive does not extend between a first side and a second side of a shuttle. As a result, an example shuttle drive and/or pump drive described herein does not span an area underneath a cap sled, thereby reducing the number of components, further reduces the height of the printer mechanism and, thus, manufacturing costs. In some examples, the shuttle drive is selectively coupled to a printer drive via a shuttle clutch pivotally coupled relative to the shuttle. The shuttle clutch pivots relative to the shuttle between a first position to couple the shuttle drive and the printer drive and a second position to disengage the shuttle drive and the printer drive. In particular, the shuttle clutch is activated by carriage interference as a carriage moves into the service station. Further, the shuttle drive includes a bypass to enable the printhead mechanisms to bypass a wiping operation of the service station. Additionally, unlike conventional printers, the example service stations described herein do not include a spittoon dedicated housing. Instead, the service station is coupled to a printer chassis. For example, shuttle bearing, capture, and/or motion limiting features of the service station are integrated with a printer chassis.

To further reduce the overall height of the service station, a pump is positioned above and/or adjacent an end of the shuttle (e.g., a rearward portion of the cap sled) and is operatively coupled to the printer drive via the pump drive. To activate the pump, a pump clutch selectively couples the pump drive and the printer drive. Unlike conventional service stations, the pump clutch is activated via an actuator of the shuttle that is positioned underneath the pump and adjacent the end of the shuttle when, for example, the shuttle is in a fully extended position or capping position.

Additionally, the example service station apparatus described herein employs absorbers disposed adjacent the second side or non-transmission side of the shuttle. Unlike conventional service stations, an absorber of the example service station apparatus described herein is not disposed underneath the cap sled and have a simple shape or profile (e.g., a rectangular profile), thereby significantly reducing manufacturing costs.

Turning more specifically to the illustrated examples, FIG. 1 depicts a fluid ejection system or printer apparatus 100 having an example service station 102 described herein. For example, the printer apparatus 100 of the illustrated example is depicted as an ink-jet printing system. In the example of FIG. 1, the printer apparatus 100 includes an excitation source or printhead assembly 104 supported by carriage 106. The carriage 106 moves the printhead assembly 104 between a print zone 108 and a service station zone 110. Fluid supply cartridges 112*a-d* are removably coupled to the printhead assembly 104 and supply fluid or ink to the printhead assembly 104. For example, the fluid supply cartridges 112*a-d* may contain fluids or inks such as, for example, black ink, yellow ink, magenta ink, cyan ink, etc. Alternatively, each of the fluid supply cartridges 112*a-d* may contain any other ink or fluid, and/or each of the fluid supply cartridges 112*a-d* may hold more than one color ink or fluid.

To generate a pattern, images and/or other visual representations, a controller, processor or other circuit logic 114 receives instructions from a host device such as a personal computer and controls the operation of the printer apparatus 100. For example, the controller 114 causes a feed drive 116 (e.g., a motor driven roller) to advance a print media or substrate through the print zone 108. Further, the controller 114 causes the carriage 106 and, thus, the printhead assembly 104 to traverse along a scan axis 118 (or an X-axis) as the print media is moving through the print zone 108 and the controller 114 causes the printhead assembly 104 to expel or generate ink droplets onto the print media or substrate. The scan axis 118 of the illustrated example is provided by, for example, a carriage guide rod 120 mounted to a chassis 122 of the printer apparatus 100. To reciprocate the printhead assembly 104 along the scan axis 118 above the print media, substrate or sheet, the carriage 106 is driven via, for example, a motor and belt system (not shown). The feed drive 116 advances the print media or sheet along a feed axis 124 (or a Y-direction) that is substantially perpendicular to the scan axis 118 as the printhead assembly 104 move along the scan axis 118.

To service or maintain the printheads of the printhead assembly 104, the printer apparatus 100 of the illustrated example employs the service station 102. The service station 102 of FIG. 1 is located within the service station zone 110. The service station 102 of the illustrated example provides service station operations (e.g., spitting, priming, capping, wiping, etc.) to the print nozzles of the printhead assembly 104 during non-printing or periods of non-use. Prior to a print job, and/or after a print job, the controller 114 may cause the carriage 106 to move to a home position 126 in the service station zone 110 to service the print nozzles of the printhead assembly 104 (e.g., home right position in the orientation of FIG. 1). For example, the controller 114 may move the carriage 106 based on a signal received from a sensor (e.g., an optical sensor) that detects the position of the carriage 106 relative to the scan axis 118. The carriage 106 is in the home position 126 when the carriage 106 is positioned adjacent (e.g., immediately adjacent) a first side 128 of the chassis 122. As described in greater detail below, the service station 102 is activated via carriage interference when the carriage 106 is positioned in the home position 126.

For the purpose of driving the service station 102, a power take-off 130 operatively couples a motor or printer drive 132 of the printer apparatus 100 to the service station 102. For example, the printer drive 132 of the illustrated example is the media feed drive 116. The power take-off 130 of FIG. 1 is a drive member or gear 134 operatively coupled to a motor of the feed drive 116 via a shaft 136 (e.g., a feed-shaft). As shown, the shaft 136 extends across the print zone 108 along the scan axis 118 between the first side 128 of the chassis 122 and a second side 138 of the chassis 122 opposite the first side 128. When driven by the power take-off 130, the service station 102 of the illustrated example moves generally along a service station or shuttle axis 140 (or the Y-axis)

that is substantially perpendicular to the scan axis 118 (or the X-axis) between a first end or position 142 (e.g., an extended position) adjacent a first or front edge 144 of the printer chassis 122 and a second end or position 146 (e.g., a rearward position) adjacent a second or rear edge 148 of the printer chassis 122. In some examples, the service station 102 may be positioned to a fully retracted or fully rearward position (i.e., beyond the position 148) to drive, for example, a print media feed mechanism (e.g., a pick arm assembly) of the printer apparatus 100.

Figure 2:
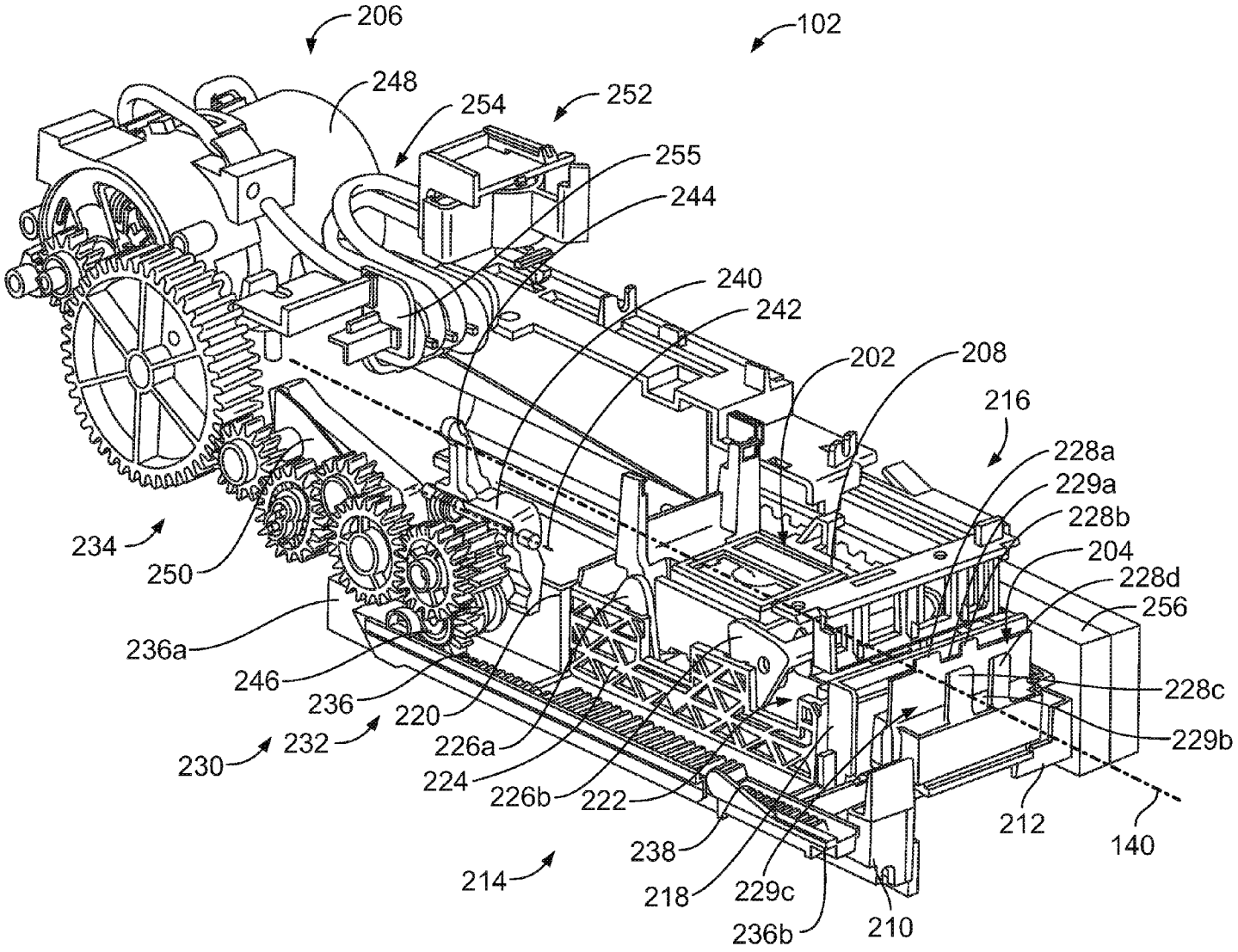
FIG. 2 depicts an example service station described herein.

FIG. 2 depicts the example service station 102 of FIG. 1. The service station 102 of the illustrated example includes a capping assembly 202 to provide a capping operation, a wiper assembly 204 to provide a wiping operation, and pump assembly 206 to provide a priming operation and/or a purging operation.

For the purpose of providing a seal to the printhead assembly 104 during a capping operation or periods of non-use, the capping assembly 202 of FIG. 2 includes a cap sled 208. To move the cap sled 208 to a capping position, the example service station 102 of the illustrated example employs a shuttle 210. The shuttle 210 of the illustrated example has a housing or body 212 having a first side 214 (e.g., a transmission side) and a second side 216 (e.g., a non-transmission side) opposite the first side 214. The shuttle 210 of FIG. 2 also includes a first wall or end 218 and a second wall or end 220 opposite the first wall 218 to define an opening or cap sled area 222 to receive the cap sled 208.

To couple the cap sled 208 to the shuttle 210, the service station 102 of the illustrated example includes a raft 224 disposed in the cap sled area 222 between the first and second walls 218, 220 of the shuttle 210. As shown in FIG. 2, the cap sled 208 is pivotally coupled to the raft 224 via linkages 226*a* and 226*b* (e.g., a four bar linkage), which cause the cap sled 208 to move between a capping position (e.g., see FIG. 8) and a non-capping position (e.g., see FIG. 4). The linkages 226*a* and 226*b* of the illustrated example have the same length and are oriented at similar or identical angles $\theta_x$ relative to the shuttle 210. The resultant motion of the cap sled 208 during a capping operation is fixed in the angle $\theta_x$ while the cap sled 208 moves relative to the shuttle in a direction parallel to the shuttle axis 140. From another perspective, during a capping operation, the linkages 226*a* and 226*b* cause the cap sled 208 to move relative to the printhead 104 in a direction substantially parallel to the Z axis.

The shuttle 210 of the illustrated example also supports the wiper assembly 204. As can be seen in FIG. 2, the wiper assembly 204 of the illustrated example is coupled to the first wall 218 of the shuttle 210. The wiper assembly 204 of the illustrated example includes a first wiper blade 228*a* adjacent to or spaced from a second wiper blade 228*b* relative to the Y-axis to define a first gap 229*a*. The wiper assembly 204 also includes a third wiper blade 228*c* adjacent to or spaced from a fourth wiper blade 228*d* relative to the X-axis to define a second gap 229*b*. The first and second wiper blades 228*a*, 228*b* are spaced from the third and fourth wiper blades 228*c*, 228*d* relative to the Y-axis to define a gap 229*c*. The wiper blades 228*a-d* may have substantially the same size, shape or profile. Alternatively, each of the wiper blades 228*a-d* may have different sizes, shapes or profiles.

In reference to FIG. 1, in operation, the shuttle 210 moves the cap sled 208 and the wiper assembly 204 along the shuttle axis 140 (or the Y-axis) between the first position 142 and the second position 146. To move or drive the cap sled 208 and the wiper assembly 204 along the shuttle axis 140, the shuttle 210 of the illustrated example employs a service station drive assembly 230. In particular, the service station drive assembly 230 includes a shuttle drive assembly 232 to operatively couple the shuttle 210 and the printer drive 132, and a pump drive assembly 234 to operatively couple the pump assembly 206 and the printer drive 132.

To move the shuttle 210 in a rectilinear motion along the shuttle axis 140, the shuttle drive assembly 232 of the illustrated example includes a shuttle drive or linear actuator 236. The shuttle drive assembly 232 moves the shuttle 210 between a fully extended position (e.g., the first position 142) defined by a first end 236*a* of the shuttle drive 236 and a retracted position (e.g., the second position 146) defined by a second end 236*b* of the shuttle drive 236. In other words, the shuttle drive 236 propels or moves the shuttle 210 forward and rearward along the Y-axis between stop positions defined by the first and second ends 236*a*, 236*b*. As used herein, "forward" with respect to the shuttle 210 means movement of the cap sled 208 along the Y-axis in a direction toward the carriage 106 (e.g., the first position 142) and "rearward" with respect to the shuttle 210 means movement of the cap sled 208 along the Y-axis in a direction away from the carriage 106 (e.g., the second position 146).

The shuttle drive 236 of the illustrated example is a track or rack gear 238 disposed adjacent the first side 214 of the shuttle 210 and substantially parallel to the shuttle axis 140. As shown in FIG. 2, the rack gear 238 is integrally formed with the shuttle 210 as a unitary piece or structure.

To selectively couple the shuttle 210 to the printer drive 132, the shuttle drive assembly 232 employs a shuttle clutch 240 that is activated via carriage interference. The shuttle clutch 240 is pivotally coupled relative to the shuttle 210 and the shuttle drive 236. In particular, the shuttle clutch 240 of the illustrated example pivots relative to the shuttle drive 236 about a clutch axis or pin 242 that is substantially parallel to the shuttle axis 140. As can be seen in FIG. 2, the shuttle clutch 240 has an actuator arm 244 coupled to a clutch gear 246 such that rotation of the actuator arm 244 about the clutch axis 242 causes the clutch gear 246 to move relative to the rack gear 238 between a first or engaged position such that the clutch gear 246 engages the rack gear 238 and a second or disengaged position such that the clutch gear 246 disengages from the rack gear 238. In the engaged position, the shuttle clutch 240 operatively couples the shuttle drive 236 and the printer drive 132, and in the disengaged position the shuttle clutch 240 operatively decouples the shuttle drive 236 and the printer drive 132. Thus, when the clutch gear 246 engages the rack gear 238, the shuttle drive assembly 232 of the illustrated example provides a rack-and-pinion gear system.

As noted above, to provide a priming operation or a purging operation, the service station 102 employs the pump assembly 206. The pump assembly 206 of the illustrated example includes a pump 248 (e.g., a peristaltic pump) disposed adjacent the first end 236*a* of the shuttle drive 236 or behind the cap sled 208 in the orientation of FIG. 2. Additionally, in the illustrated example of FIG. 2, the pump 248 is at least partially disposed above the cap sled 208 (e.g., in the Z-axis direction). The pump drive assembly 234 operatively couples the printer drive 132 and the pump 248. To selectively couple the pump drive assembly 234 and the printer drive 132, the pump drive assembly 234 employs a pump clutch 250, which is described in greater detail below in connection with FIGS. 3A and 3B.

Additionally, to provide proper ventilation during a capping operation and/or a priming operation, the service station 102 employs a vent assembly 252. Similar to the shuttle clutch 240, the vent assembly 252 is also activated by carriage interface. The vent assembly 252 is fluidly coupled to the cap sled 208 and the pump 248 via tubing 254. Further, although not shown in FIG. 2, the cap sled 208 is fluidly coupled to the pump 248 via one or more tubes (see FIGS. 9 and 10) that are attached to a coupler 255 at a first end and a bottom of the cap sled 208 at a second end. Portions of the tubes extending between the pump 248 and the cap sled 208 have been omitted from FIG. 2 for clarity.

Further, to absorb or capture primed ink (e.g., from a purging operation), the service station 102 employs one or more absorbers 256 (absorber pads, foam pads, etc.) disposed along the second side 216 (or non-transmission side) of the shuttle 210. Unlike conventional absorbers, the absorbers 256 of FIG. 2 have a simple shape or profile (e.g., a rectangular shape or profile).

Figure 3A:
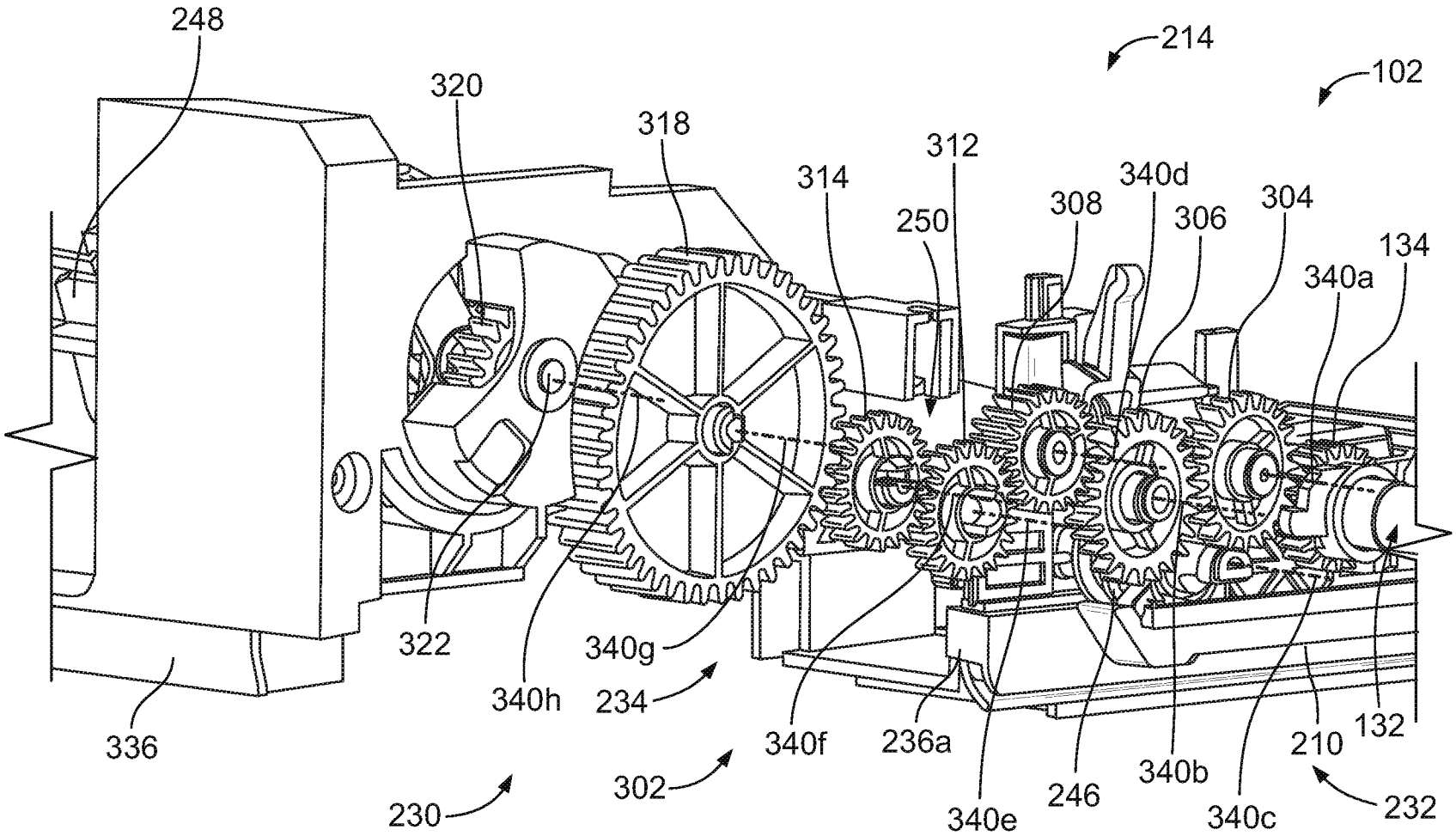
FIG. 3A depicts a first side of the example service station of FIG. 2.
Figure 3B:
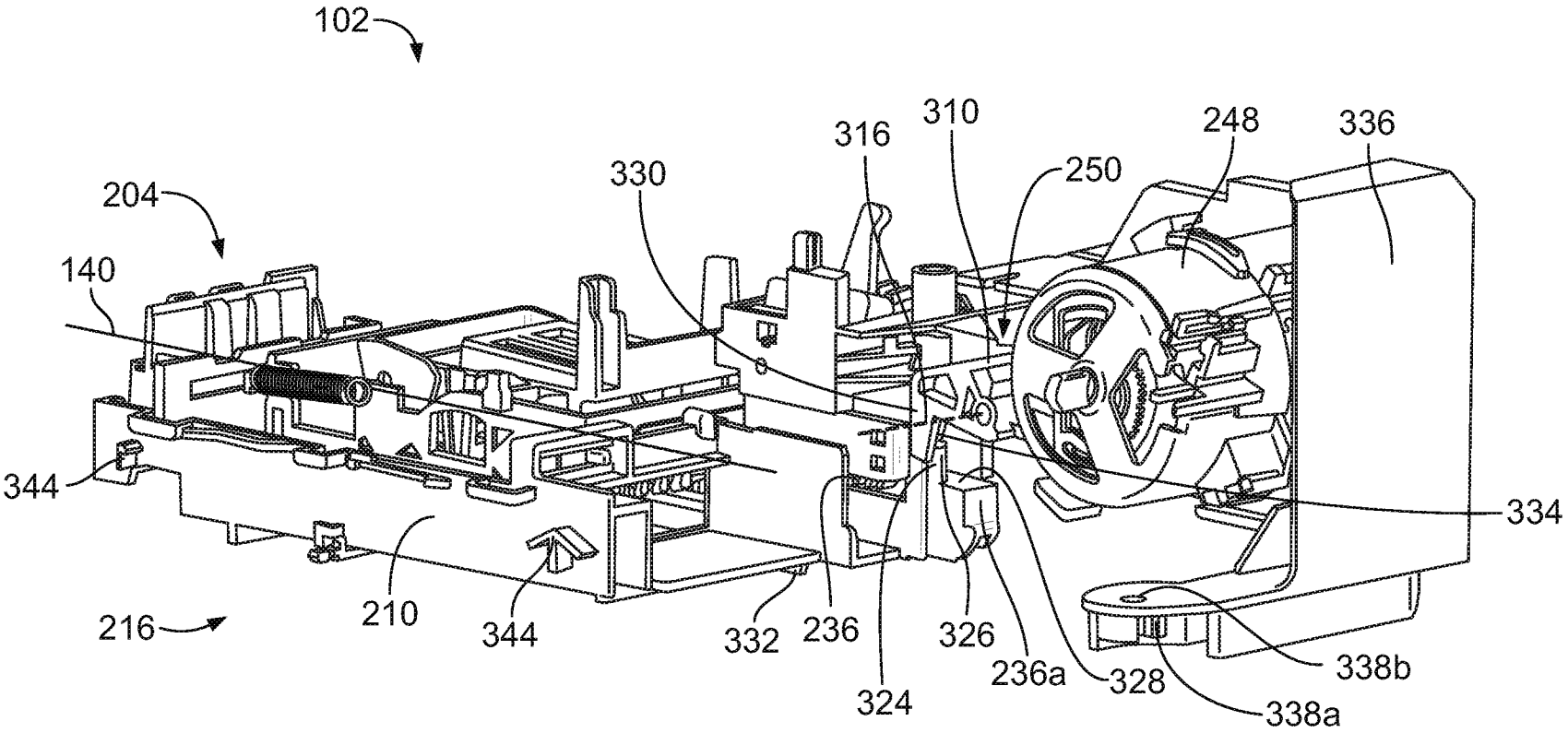
FIG. 3B depicts a second side of the example service station of FIG. 2.

FIG. 3A depicts the service station 102 of FIGS. 1 and 2 showing the first side 214 of the shuttle 210. FIG. 3B depicts the service station 102 of FIGS. 1 and 2 showing the second side 216 of the shuttle 210.

Unlike conventional service stations, the service station drive assembly 230 of the illustrated example of FIGS. 1, 2, 3A and 3B is positioned on the first side 214 of the shuttle 210 and does not extend between the first and second sides 214, 216 of the shuttle 210. In particular, both the shuttle drive assembly 232 and the pump drive assembly 234 of the illustrated example are positioned such that shuttle drive assembly 232 and the pump drive assembly 234 do not extend between the first side 214 and the second side 216 of the shuttle 210. In this manner, the service station drive assembly 230 employs significantly fewer components and reduces the overall dimensional envelope or height because a print mechanism can be positioned adjacent the shuttle (e.g., no other components are positioned between a print mechanism and the shuttle) than, for example, a conventional service station drive assembly.

Referring to FIG. 3A, the service station drive assembly 230 of the illustrated example is a gear train 302. The gear train 302 defines the shuttle drive assembly 232 and the pump drive assembly 234. In particular, the service station drive assembly 230 of the illustrated example is arranged in series or in-line relative to the shuttle axis 140 such that the shuttle drive assembly 232 actuates or activates the pump drive assembly 234.

To couple the shuttle drive assembly 232 to the printer drive 132, the shuttle drive assembly 232 includes a shuttle cluster drive or member 304 (e.g., a gear). The shuttle cluster drive 304 of the illustrated example is in constant mesh with the power take-off gear 134 and the clutch gear 246. Also, to operatively couple the printer drive 132 to the pump 248, the pump drive assembly 234 includes a pump cluster drive or member 306 (e.g., a gear) that is coupled to or in constant mesh with the shuttle cluster drive 304 and a transfer gear 308. In particular, the shuttle cluster drive 304, the pump cluster drive 306 and the transfer gear 308 remain operatively coupled to the power take-off gear 134 of the printer drive 132 during operation of the printer apparatus 100.

Figure 4:
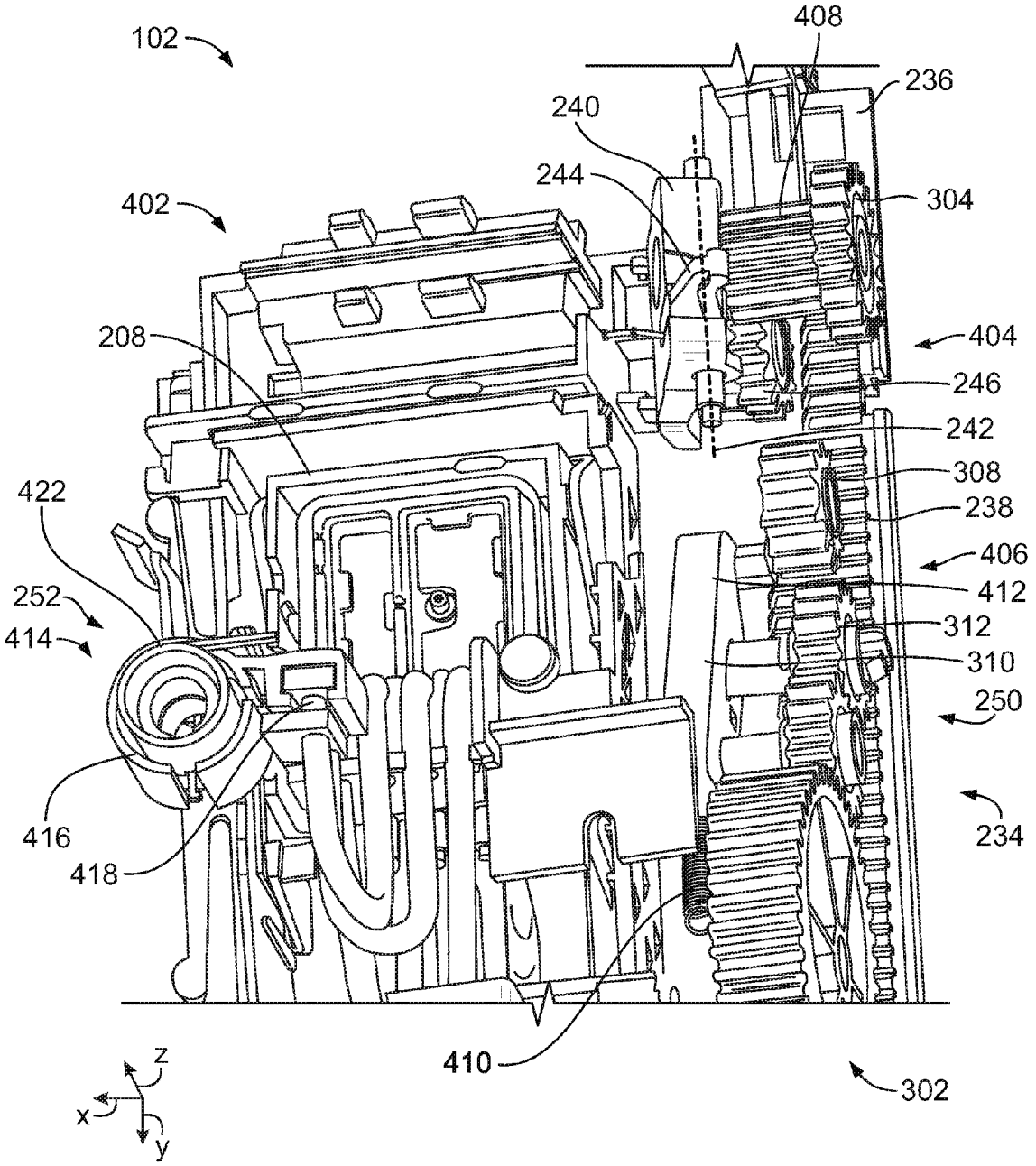
FIG. 4 depicts the example service station of FIG. 2 in a retracted position.

As noted above, the pump clutch 250 selectively couples and decouples the pump 248 from the printer drive 132. The pump clutch 250 of the illustrated example has a swing arm or lever 310 (FIG. 3B) with a gear 312 (FIG. 3A). The lever 310 and gear 312 are pivotally coupled relative to the shuttle 210 about an axis 316 (FIG. 3B) that is substantially perpendicular to the shuttle axis 140. The gear 314 spins along the axis 316 and is in constant mesh with the clutch gear 312. The pump clutch 250 pivots relative the shuttle 210 between a first or engaged position as shown in FIG. 3A and a second or disengaged position as shown in FIG. 4. To operatively couple the pump drive assembly 234 and the printer drive 132, the pump clutch 250 is moved to the engaged position. In the engaged position, the first or front gear 312 of the pump clutch 250 engages the transfer gear 308 and the second or rear gear 314 engages another transfer gear 318, which is coupled to a gear 320 of an output shaft 322 of the pump 248. In the disengaged position, the lever 310 of the pump clutch 250 pivots about the axis 316 such that the front gear 312 disengages the transfer gear 308 to operatively decouple the pump drive assembly 234 and the printer drive 132.

As most clearly shown in FIG. 3B, to position the pump clutch 250 in the engaged position, the shuttle 210 includes an actuator 324 adjacent the first end 236*a* of the shuttle drive 236. The actuator 324 of the shuttle 210 actuates the pump clutch 250 when the clutch gear 246 is adjacent the first end 236*a* of the shuttle drive 236. For example, the pump clutch 250 is activated by the actuator 324 when the shuttle 210 is in the fully extended position (e.g., the position 142 of FIG. 1).

The actuator 324 of the illustrated example is a raised lip portion or protrusion 326 extending from a bearing surface 328 (e.g., a flat or upper bearing surface) of the shuttle drive 236 adjacent the first end 236*a* of the shuttle 210. The raised lip portion 326 protrudes away from the shuttle axis 140 in a direction that is substantially perpendicular to the shuttle axis 140 and the scan axis 118 (e.g., along the Z-axis). The lever 310 has a nose or hook member 330 disposed at an angle relative to the lever 310 and protruding toward the actuator 324. In operation, the actuator 324 engages or slides against the nose 330 of the lever 310 via interference to cause the lever 310 of the pump clutch 250 to pivot or swing about the axis 316 in a direction (e.g. about an axis parallel to the scan axis) away from a lower surface 332 of the shuttle 210 when the shuttle 210 is in the fully extended position. The nose 330 of the illustrated example includes a recessed track 334 to receive and/or guide the lip portion 326 relative to the nose 330.

When the actuator 324 moves away from the lever 310, the lever 310 pivots to the disengaged position. For example, when the shuttle 210 moves toward the second position 146 (e.g., a retracted position), the actuator 324 releases the lever 310 of the pump clutch 250, which causes the pump clutch 250 to move or pivot to the disengaged position. In disengaged position, the lever 310 of the illustrated example pivots toward the lower surface 332 of the shuttle 210. When the shuttle 210 moves in a direction toward the retracted position 146, rotation of the gears 308 and 314 provide a downward force on the teeth of the gear 312, causing the gear 312 to disengage from the gear 308.

Thus, while the gear teeth of the gears 308, 314 and 312 are engaged, the gear teeth put a load on one another. For example, when the shuttle 210 is moving to an uncapped position (toward the position 146) while the teeth of the gears 308, 312, 314 are in engagement, the teeth of the gears 308 and 314 provide or impart a force on the teeth of the gear 312 in a direction toward the surface 332 (e.g., a downward direction in the orientation of FIG. 3A). As a result, the lever 310 pivots about the axis 316 toward the surface 332 and cause the gear 312 to disengage the gear 308 when the pump actuator 324 disengages or moves away from the lever 310. In this manner, rotation of the drive 132 in a direction to move the shuttle 210 to an uncapped position causes the pump clutch 250 to disengage the drive 132. Additionally, during a capping operation, the gears 308 and 314 rotate in an opposite direction compared to the uncapping operation. As a result, the gears 308 and 314 facilitate engagement with the gear 312. For example, the rotational direction of the gears 308 and/or 314 provide a force (e.g., away from the surface 332) to move the gears 308, 312 and 314 in meshing engagement.

However, when the drive 132 is performing a color prime or purge operation while the shuttle 210 is in a capped position (e.g., the position 142), rotation of the pump 248 causes the gears 308 and 314 to rotate in a rotational direction that is similar to the rotational direction of the gears 308 and 314 when rotated during the uncapping operation as described above. In other words, during a color priming or purging operation, rotation of the gears 308 and 314 impart a force to the clutch gear 312 in a direction toward surface 332, thereby biasing gear 312 and lever 310 to a disengaged position. However, the bearing surface 328 of the clutch actuator 326 prevents the lever 310 (and the gear 312) from pivoting about the axis 316 in a direction toward surface 332 (e.g., a downward direction) to avoid disengagement of the gear 312 and the gear 308 due to the forces imparted to the gear 312 by the gears 308 and 314 during a color prime or purge operation when the shuttle 210 is in the capped position.

To couple the service station drive assembly 230 to the chassis 122 of the printer apparatus 100, the service station 102 includes a housing or frame 336. For example, the housing 336 includes a boss or mounting flange 338*a* having an aperture 338*b* to receive a fastener to secure the housing 336 to the chassis 122.

Additionally, the frame or housing 336 supports or couples the gear train 302 relative to the shuttle 210. More specifically, the housing 336 couples the shuttle drive assembly 232, the pump drive assembly 234, the pump 248, and the components of the gear train 302 relative to the shuttle 210. Additionally, the pump clutch 250 and the shuttle clutch 240 are pivotally coupled or attached to the housing 336. As most clearly shown in FIG. 3A, the cluster drives 304 and 306 and gears 246, 308, 314, 318, and 320 are rotatably coupled to the housing 336 via, for example, shafts or spindles and rotate relative to the housing 336 about respective axes 340*a-h*. Each of the axes 340*a-h* is substantially perpendicular to the shuttle axis 140 and/or the clutch axis 242 (FIG. 2) and substantially parallel to the pivot axis 316 (FIG. 3B). The lever 310 (which houses gear 312) and the gear 314 have a mutual rotational axis 340*f*.

Ribs or features 344 retrain the shuttle 210 to the printer chassis 122 in the Z axis direction. Also, the wiper assembly 204 is coupled to the shuttle 210 via a press fit connection.

Turning to FIG. 4, the service station 102 is shown in a fully retracted position 402. In other words, the service station 102 is in a non-use position when, for example, the carriage 106 is in the print zone 108 and the print head assembly 104 are being controlled to expel ink on a print media. Some of the components of the gear train 302 in FIG. 4 have been removed for clarity. For example, the printer drive 132 and the pump cluster drive 306 have been removed, etc.

In the retracted position 402 of FIG. 4, the shuttle clutch 240 and the pump clutch 250 are in respective disengaged positions 404 and 406. Thus, in the retracted position 402, the power take-off 130 is operatively decoupled from the shuttle drive 236 and the pump drive assembly 234 via the respective shuttle clutch 240 and the pump clutch 250.

In the retracted position 402, the clutch gear 246 of the shuttle clutch 240 is adjacent (e.g., immediately adjacent) the second end 236*b* of the shuttle drive 236. Additionally, in the disengaged position 404, the clutch gear 246 of the shuttle clutch 240 is operatively decoupled from the rack gear 238. As shown in FIG. 4, although the clutch gear 246 is coupled or enmeshed with a spindle portion 408 of the shuttle cluster drive 304, the clutch gear 246 of the shuttle clutch 240 is positioned away from or disengaged from the rack gear 238 to operatively decouple the shuttle drive 236 and the printer drive 132. In particular, a biasing element (not shown) of the shuttle clutch 240 biases the arm 244 toward the rack gear 238 to cause the clutch gear 246 to retract toward the cap sled 208 and the away from the rack gear 238.

Likewise, in the retracted position 402, the pump clutch 250 is operatively decoupled from the transfer gear 308. As shown in FIG. 4, to help bias the lever 310 of the pump clutch 250 to the disengaged position 406, the pump clutch 250 employs a biasing element 410 (e.g., a spring). The biasing element 410 causes a front portion 412 of the lever 310 to pivot or swing toward the rack gear 238 when the actuator 324 (FIG. 3B) does not engage or contact the lever 310. As shown in FIG. 4, in the disengaged position 406, the front gear 312 of the pump clutch 250 is decoupled from the transfer gear 308.

Also, in the fully retracted position 402, the vent assembly 252 is in a closed position 414. The vent assembly 252 includes a vent valve 416 that closes a vent 418. In particular, the vent valve 416 includes a sealing member 420 that is biased toward the vent 418 via a biasing element 422 (e.g., a torsion spring). In the closed position 414, the sealing member 420 sealingly engages the vent 418 to prevent flow through the vent 418 to close or prevent air flow to the pump 248 (e.g., a pump inlet) and the cap sled 208.

Figure 5:
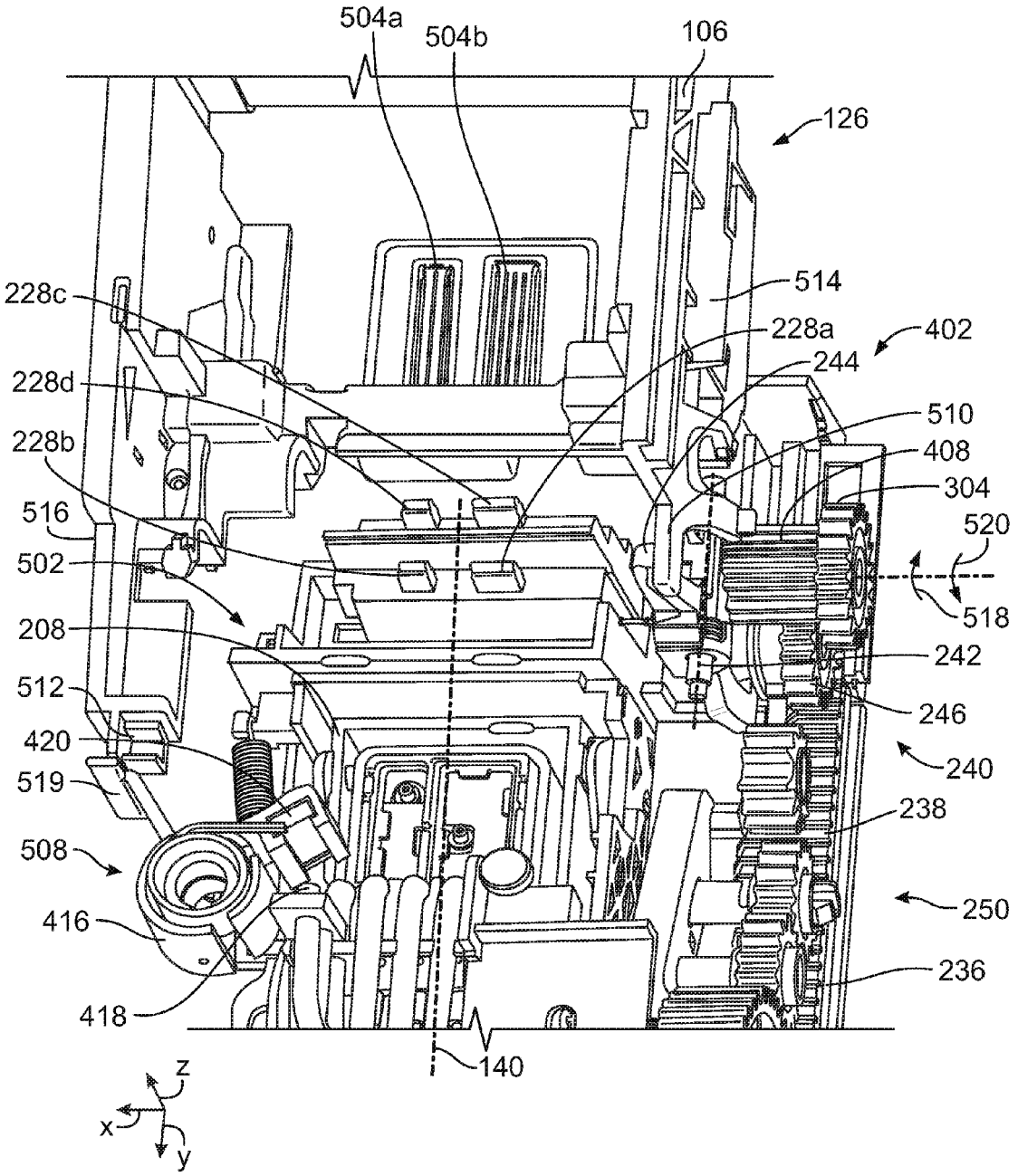
FIG. 5 depicts the example service station of FIG. 2 and a carriage of a printer apparatus in a home position relative to the service station when the service station is in the retracted position.

FIG. 5 depicts the service station 102 in the fully retracted position 402 with the carriage 106 in the service station zone 110 or the home position 126. In the example of FIG. 5, the cap sled 208 is in a non-capping position 502. For clarity, only nozzle plates 504*a* and 504*b* of the respective printhead assembly 104 of FIG. 1 are shown relative to the carriage 106. The other components of the print head assembly 112 and all ink supplies are omitted for clarity. In the illustrated example, the nozzle plate 504*a* corresponds to, for example, a printhead associated with expelling a first ink (e.g., black ink) and the second nozzle plate corresponds to, for example, a printhead associated with expelling a second ink (e.g., a color ink). Additionally, similar to FIG. 4, the pump cluster drive 306 (FIG. 3A) and the power take-off 130 (FIG. 3A) are removed from FIG. 5 for clarity.

As shown in FIG. 5, the service station 102 of the illustrated example is activated by interference with the carriage 106. For example, after the print job is complete, or prior to a print job, the service station 102 is activated to perform maintenance on the printheads associated with the nozzle plates 504*a* and 504*b*. For example, the controller 114 commands the carriage 106 to move to the home position 126. As the carriage 106 approaches to home position 126 of the service station area 110, the carriage 106 activates the shuttle clutch 240. Additionally, in the home position 126, the carriage 106 moves the vent valve 416 to an open position 508 (e.g., a fully open position).

To activate the shuttle clutch 240 and the vent valve 416 via carriage interference, the carriage 106 of the illustrated example includes a first protruding member or leg 510 and a second protruding member or leg 512. The first leg 510 is positioned on a first side 514 of the carriage 106 to engage or activate the shuttle clutch 240 and the second leg 512 is positioned on a second side 516 of the carriage 106 to activate the vent valve 416. As the carriage 106 moves to the home position 126, the second leg 512 of the carriage 106 does not interfere with the operation of the arm 244 of the shuttle clutch 240 because the second leg 512 is dimensioned or sized to provide a clearance between the second leg 512 and the arm 244 of the shuttle clutch 240 when the second leg 512 moves across the shuttle 210 along the X-axis (perpendicular to the shuttle axis 140).

As shown in FIG. 5, the first leg 510 of the carriage 106 engages the arm 244 of the shuttle clutch 240 when the carriage 106 is in the home position 126. In particular, the first leg 510 of the carriage 106 causes the arm 244 to pivot relative to the clutch axis 242. In turn, the clutch gear 246 translates or moves relative to the shuttle 210 such that the clutch gear 246 engages the rack gear 238 of the shuttle drive 236. As noted above in FIG. 4, the clutch gear 246 is coupled to the shuttle cluster drive 304 via the stem 408. When the clutch gear 246 moves into engagement with the rack gear 238, the shuttle drive 236 is coupled to the printer drive 132 (see FIG. 2). The printer drive 132 rotates the shuttle cluster drive 304 in a first direction 518 (e.g., a clockwise position) to move the shuttle 210 from the retracted position 402 to a capping position shown in FIG. 8. In particular, the clutch gear 246 rotates relative to the rack gear 238 to cause the shuttle 210 and, thus, the cap sled 208 to move toward the carriage 106. To move the cap sled 208 in a direction away from the carriage 106, the printer drive 132 rotates the shuttle cluster drive 304 in a second direction 520 (e.g., a counter-clockwise direction) opposite the first direction 518.

Additionally, as shown in FIG. 5, the second leg 512 engages an actuator 519 of the vent valve 416 when the carriage 106 is in the home position 126. The second leg 512 of the carriage 106 causes the actuator 519 to pivot or move the sealing member 420 away from the vent 418 to move the vent valve 416 to the open position 508.

Further, when the clutch gear 246 is engaged with the rack gear 238 and the carriage 106 is in the home position 126 as shown in FIG. 5, the wipers 228*a-d* of the wiper assembly 204 are aligned with the nozzle plates 504*a* and 504*b*. As the shuttle 210 drives the wiper assembly 204 toward and past the carriage 106 along the shuttle axis 140, the wipers 228*a-d* engage or wipe the nozzle plates 504*a* and 504*b* to remove ink residue, paper dust, and other debris that may have collected on the printheads and/or the nozzle plates 504*a* and 504*b*. The wipers 228*a-d* of the illustrated example may be composed of an elastomeric material or plastic material.

A wiping operation, for example, may be performed after a priming operation, periodically during printing, after a spitting event, or any other event our routine that involves uncapping. In some instances, however, a wiping operation is not performed or may be bypassed.

FIG. 6A-6D are partial views of the service station 102 depicting a bypass operation when a wiping operation is not performed or required. The bypass operation may be controlled via, for example, the controller 114. For example, the controller 114 may determine the position of the carriage 106 via a positioner or other sensor(s) (e.g., an optical sensor) and provide one or more signals to a motor of the carriage 106 to move the carriage 106 relative to the scan axis 118.

As shown in FIG. 6A-6D, the rack gear 238 of the illustrated example has a first plurality of gear teeth 602 and a second plurality of gear teeth 604 arranged between the first and second ends 236*a*, 236*b* of the shuttle drive 236. The first plurality of gear teeth 602 and a first portion 606 of the second plurality of gear teeth 604 that is aligned with the first plurality of gear teeth 602 define a non-bypass shuttle drive track 608 schematically illustrated by a first set of dashed lines. A second portion 610 of the second plurality of gear teeth 604 that is off set relative to, or which is not aligned with, the first plurality of gear teeth 602 define a bypass shuttle drive track 612 schematically illustrated by a second set of dashed lines. As shown in FIGS. 6A-6D, the second plurality of gear teeth 604 has a larger length or width than the first plurality of gear teeth 602 to define the second portion 610 and the bypass track 612. In the illustrated example, the first and second plurality of gear teeth 602, 604 of the rack gear 238 are orientated in a direction along the Z-axis opposite the lower surface 332 and toward the gear train 302. Thus, only one side of the rack gear 238 includes gear teeth.

Figure 6B:
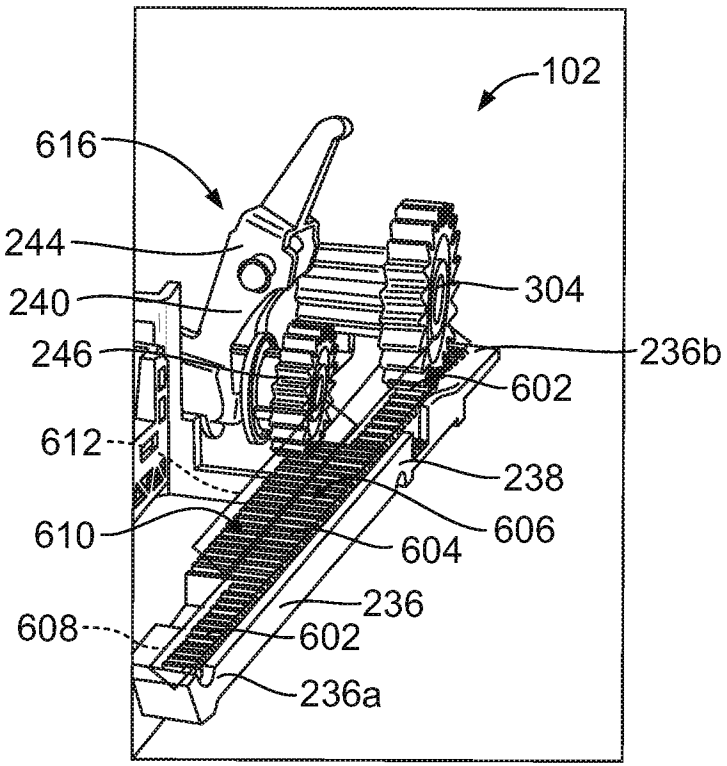
FIGS. 6A-6D are partial views illustrating a bypass operation of the example service station of FIG. 2.
Figure 6A:
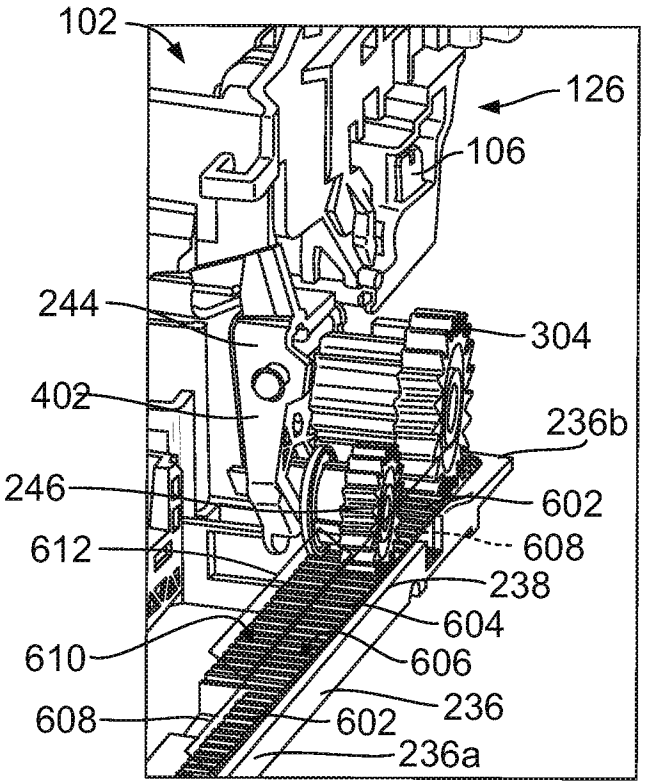

As shown in FIG. 6A, the carriage 106 is moved to the home position 126 such that the clutch gear 246 engages the first plurality of gear teeth 602 or the non-bypass track 608. If a wiping operation is desired, the carriage 106 remains in the home position 126 and the clutch gear 246 is driven to traverse along the non-bypass track 608 between the first end 236*a* and the second end 236*b* of the shuttle drive 236 such that the wiper assembly 204 wipes or engages the nozzle plates 504*a* and 504*b*.

To bypass the wiper operation, the carriage 106 remains in the home position 126 until the clutch gear 246 is adjacent the second plurality of teeth 604 or the bypass track 612. As shown in FIG. 6B, the carriage 106 is then moved to a carriage bypass position that is spaced away from the home position 126 in a direction along the scan axis 118 toward the print zone 108 (e.g., a distance of approximately 6 millimeters from the home position 126) such that the clutch gear 246 moves or translates to its resting or initial position. In this manner, the clutch gear 246 engages the second plurality of teeth 604.

As shown in FIG. 6B, the carriage 106 of the illustrated example may be disengaged from and/or moved away from the arm 244 of the shuttle clutch 240 and the shuttle 210 remains operatively coupled to the printer drive 132 via engagement of the clutch gear 246 with the second plurality of teeth 604 and the stem 408 of the shuttle clutch gear 304, which is coupled to the power take-off gear 134. In this manner, the printhead assembly 104 is moved out of alignment relative to the wipers 228*a-d* of the wiper assembly 204 as the shuttle 210 continues to move the cap sled 208 toward the carriage 106 to a capping position. In other words, the shuttle 210 moves independent of the carriage 106 when the clutch gear 246 engages the second plurality of teeth 604.

Figure 6D:
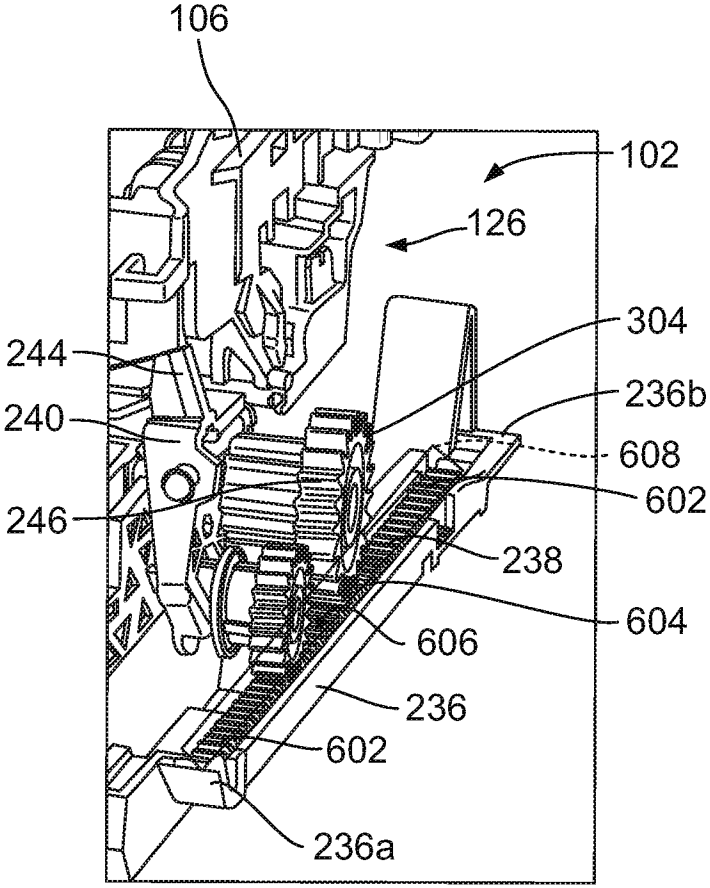
Figure 6C:
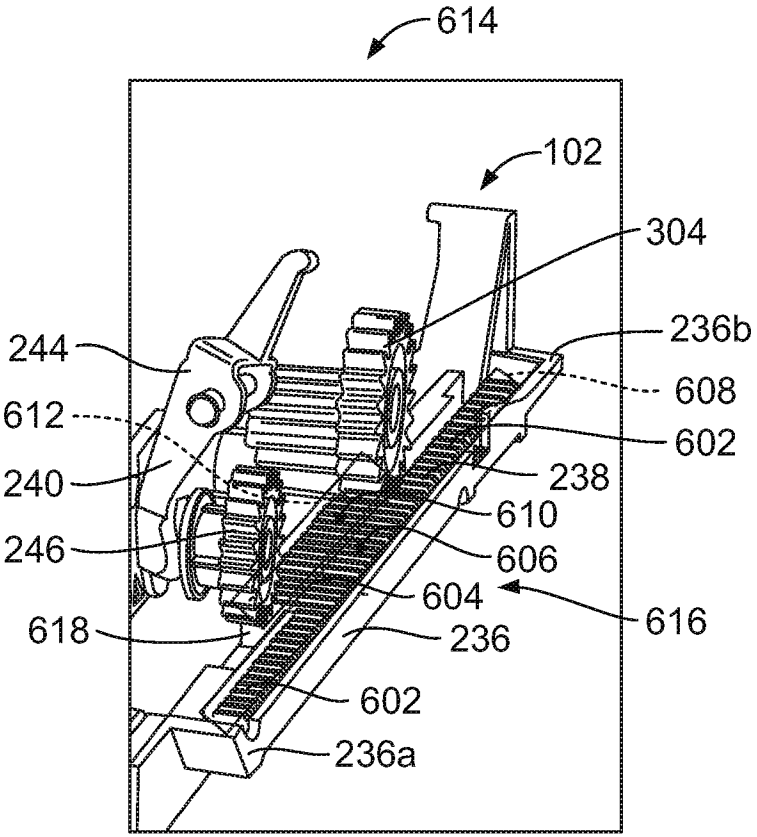

FIG. 6C illustrates the clutch gear 246 approaching an end 618 of the bypass track 612. As shown in FIG. 6D, as the clutch gear 246 approaches the end 618 of the bypass track 612, the carriage 106 is again moved or positioned to the home position 126 to engage the clutch gear 246 and the first plurality of gear teeth 602 or the non-bypass track 608. Thus, the first plurality of gear teeth 602 are sized to only allow movement of the shuttle 210 when the carriage 106 is in the home position 126. In contrast, the second plurality of gear teeth 602 is sized to allow movement of the shuttle 210 when the carriage 106 is spaced away from shuttle 210 (e.g., when the carriage 106 is in the carriage bypass position).

Figure 7:
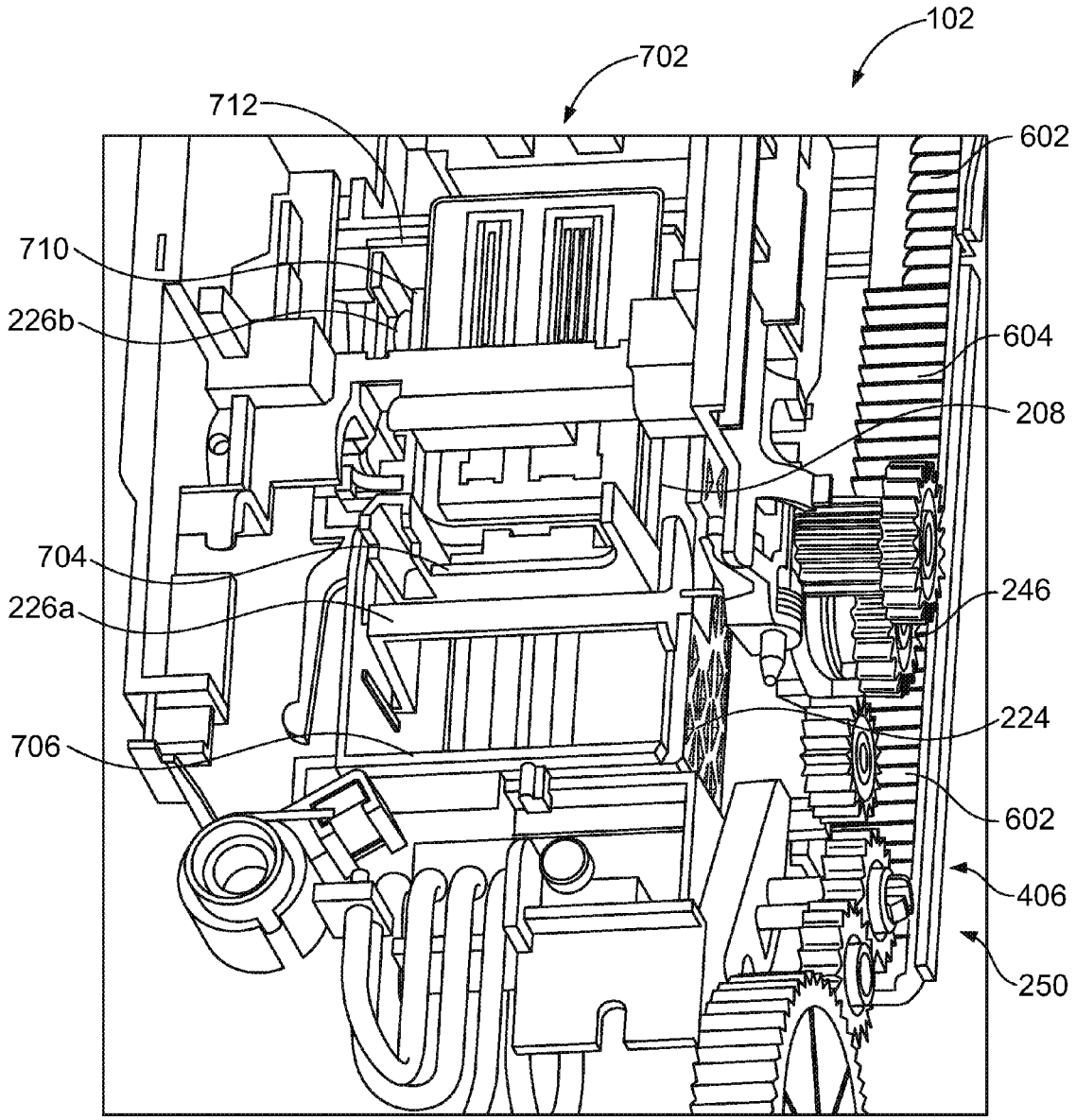
FIG. 7 depicts the example service station of FIG. 2 in a pre-cap position.
Figure 7:
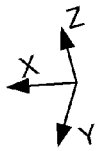

FIG. 7 illustrates the service station 102 in a pre-cap position 702. As shown in FIG. 7, the cap sled 208 moves toward the capping position of FIG. 8 after a wiping operation or a bypass operation. In the pre-cap position 702 of FIG. 7, the clutch gear 246 is engaged with the first plurality of gear teeth 602. Additionally, the pump clutch 250 is in the disengaged position 406. Also, as shown, the linkage 226*a* and a first side 704 of the cap sled 208 are positioned away from a first edge or wall 706 of the raft 224, and the linkage 226*b* and a second side 710 of the cap sled 208 are adjacent a second edge or wall 712 of the raft 224 when the cap sled 208 is in a non-capping position shown in FIG. 7.

Figure 8:
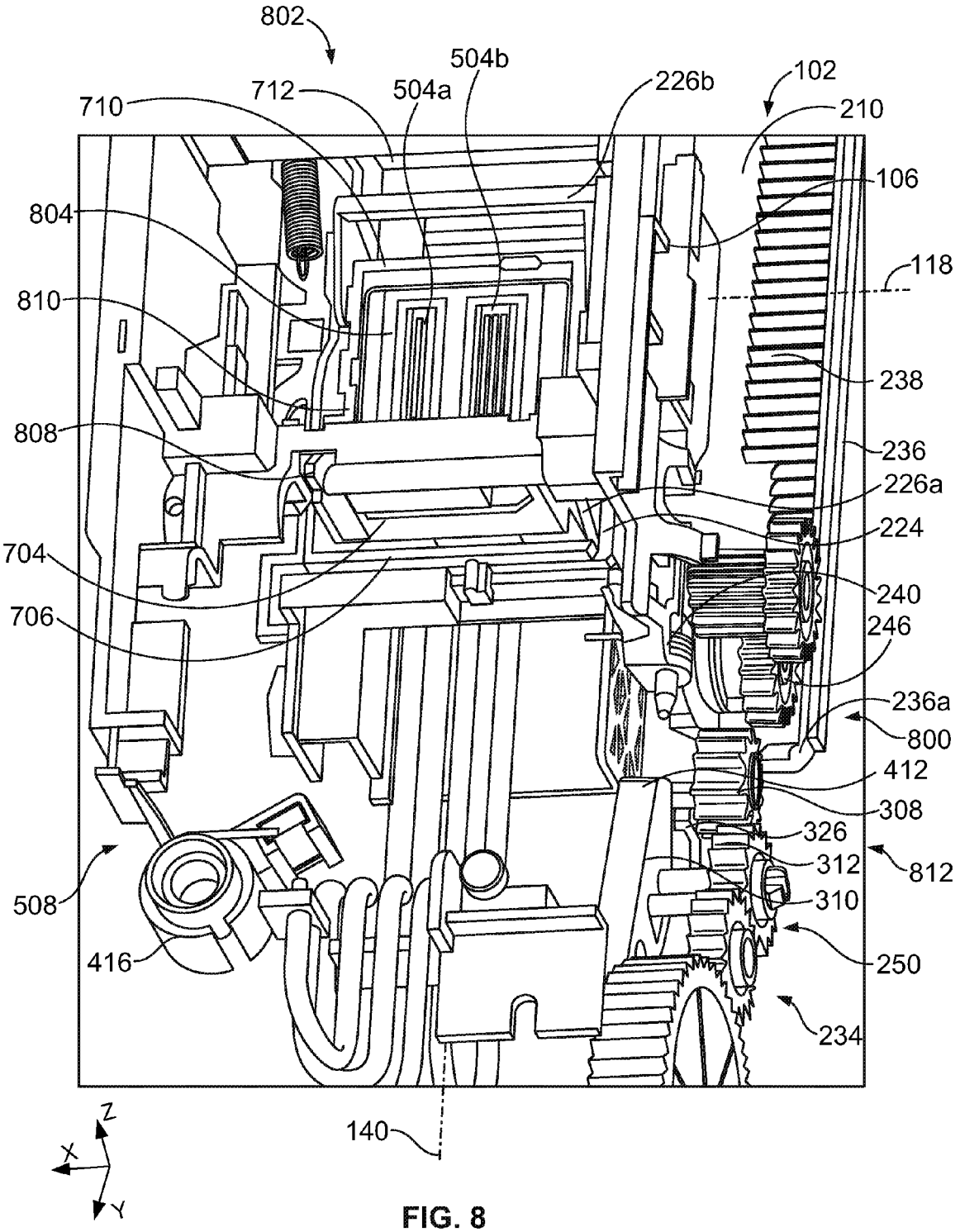
FIG. 8 depicts the example service station of FIG. 2 in a capping position.

FIG. 8 illustrates the service station 102 in a capping position 802. In the capping position 802, the printhead assembly 104 is capped in the service station 102 via the cap sled 208. To move the cap sled 208 to the capping position 802, the shuttle 210 is driven via the shuttle drive 236 until the shuttle clutch 240 is adjacent the first end 236*a* of the shuttle drive 236. In other words, the shuttle 210 is in a fully extended position 800.

As the shuttle 210 moves toward the capping position 802, the cap sled 208 moves toward the printhead assembly 104. To seal the printhead assembly 104, the cap sled 208 of the illustrated example includes a cap cover or lip portion 804. In particular, the cap sled 208 moves in a direction perpendicular to the shuttle axis 140 and the scan axis 118 (relative to the Z-axis) so that cap covers or lips 804 (e.g., rubber or plastic caps or seals) sealingly engage or enclose the nozzle plates 504*a* and 504*b* of the printhead assembly 104. The cap sled 208 seals or protects the printhead assembly 104 from contaminates and prevents drying during storage and/or during non-printing periods. Additionally, in the capping position 802 of FIG. 8, the second leg 512 of the carriage 106 moves the vent valve 416 to the open position 508 to help prevent ink drool, deprime, and/or other potential problems caused by a closed off air volume.

To move the cap sled 208 in a direction perpendicular to the shuttle axis 140 and the scan axis 118 (e.g., a vertical position relative to the raft 224), the cap sled 208 of the illustrated example includes a post 808. The post 808 of the illustrated example protrudes away from an upper surface 810 of the cap sled 208. As the shuttle 210 moves the cap sled 208 toward the capping position 802 of FIG. 8, the post 808 of the cap sled 208 engages the carriage 106. The carriage 106 captures the post 808 to cause the cap sled 208 to pivot relative to the raft 224 via the linkages 226*a*, 226*b*. As shown in FIG. 8 and in contrast to FIG. 7, the first side 704 of the cap sled 208 is adjacent the first edge or wall 706 of the raft 224 and the second side 710 of the cap sled 208 is positioned away from the second edge or wall 712 of the raft 224 when the cap sled 208 is in the capping position 802. In other words, when the post 808 engages the carriage 106, the shuttle 210 continues to move the raft 224 along the shuttle axis 140 until the clutch gear 246 is adjacent the first end 236*a* of the shuttle drive 236. The linkages 226*a*, 226*b* pivot relative to raft 224 and move or lift the cap sled 208 in an upward or vertical direction relative to the raft 224 and the printhead assembly 104.

Further, as shown in FIG. 8, the pump clutch 250 is moved to an engaged position 812. In particular, the actuator 324 of the shuttle 210 causes the front portion 412 of the lever 310 to pivot about the axis 316 (FIG. 3B) in a direction away from the rack gear 238. As noted above, in the engaged position 812, the front gear 312 engages the transfer gear 308 to operatively couple the pump drive assembly 234 and the printer drive 132. Although the pump drive assembly 234 is coupled to the printer drive 132, the pump 248 is not activated during a capping operation because the printer drive 132 is not driven. For example, the controller 114 stops or deactivates the printer driver 132.

Figure 9:
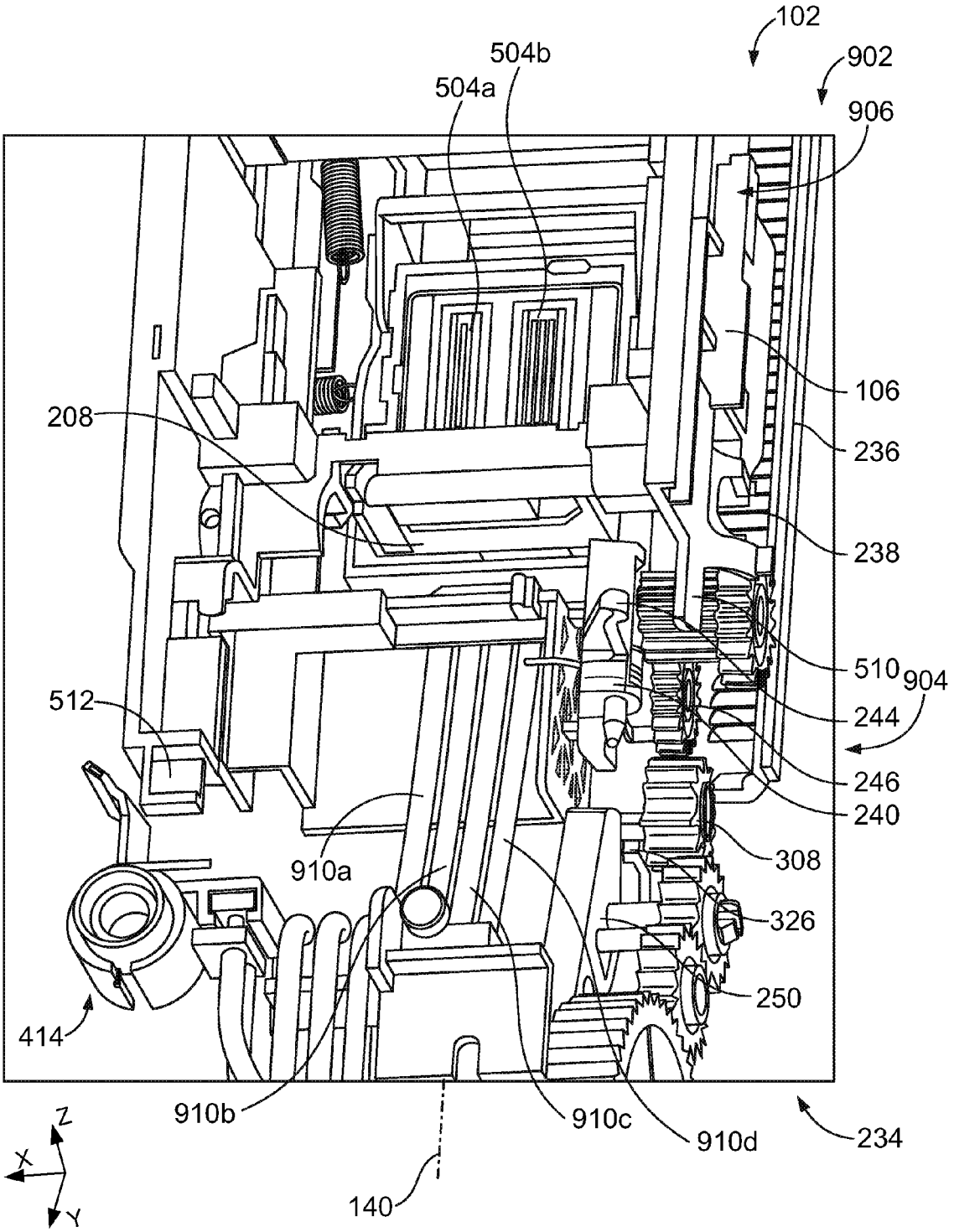
FIG. 9 depicts the example service station of FIG. 2 in a priming position.

FIG. 9 depicts the service station 102 in a priming position 902 to enable a priming operation. In the priming position 902, the actuator 324 maintains the pump clutch 250 engaged with the transfer gear 308 because the shuttle 210 is the fully extended position. In turn, the pump clutch 250 operatively couples the printer drive 132 and the pump drive assembly 234. In addition, in the priming position 902, the printhead assembly 104 is capped or sealed by the cap sled 208.

To operatively decouple the shuttle 210 and the printer drive 132, the carriage 106 is moved (e.g., via the controller 114) to a priming carriage position 906 that is spaced away from the home position 126 (e.g., 14 millimeters from the home position 126) in a direction toward the print zone 108 (FIG. 1). As a result, the first leg 510 of the carriage 106 releases the arm 244 of the shuttle clutch 240 to cause the clutch gear 246 to disengage from the rack gear 238. In this manner, the shuttle drive 236 is operatively decoupled from the printer drive 132, but the pump drive assembly 234 remains engaged or coupled to the printer drive 132. Thus, the printer drive 132 operates the pump 248 via the pump drive assembly 234 when the shuttle 210 is in the fully extended priming position 902 and the carriage 106, coupled to the cap sled 208 and raft 224, is in the carriage priming position 906.

In the priming position 902 and when the carriage 106 is in the carriage priming position 906, the second leg 512 of the carriage 106 releases the vent valve 416 to move the vent valve 416 to the closed position 414. When the vent valve 416 is in the closed position 414, air and/or fluid (e.g., ink) can be drawn from the nozzle plates 504*a* and 504*b* of the printhead assembly 104 via the seal provided by the cap sled 208.

Tubing 910*a* and 910*d* are fluidly coupled to the pump 248 and the cap sled 208, while tubing 910*b* and 910*c* are provided for venting and are fluidly coupled to the vent 414 at a first end and the cap sled 208 at a second end. During a priming operation, the pump 248 draws a vacuum on the nozzle plates 504*a* and 504*b* to pull excess air and/or clear internal dried ink clogs from the ink delivery system of the printhead assembly 104 by extracting ink from the printhead assembly 104 using negative pressure. For example, when the vent 414 is closed and the pump 248 is driven, tubing 910*a* and 910*d* are selectively occluded by rollers which create a vacuum and pull ink and air from the printhead assembly 104. To prime a printhead associated with the nozzle plate 504*a* via a channel provided by the tubing 910*a*, the printer drive 132 is driven in a first or forward direction to drive the pump 248 in a first direction. To prime a printhead associated with the nozzle plate 504*b* via a channel provided by tubing 910*d*, the printer drive 132 is driven in a second or reverse direction to drive the pump 248 in a second direction opposite the first direction. Tubing 910*b* and 910*c* (e.g., vent tubes) provide no fluid flow therethrough and to the cap sled 208 when the vent 414 is in the closed position 414 and the pump 248 is driven.

Figure 10:
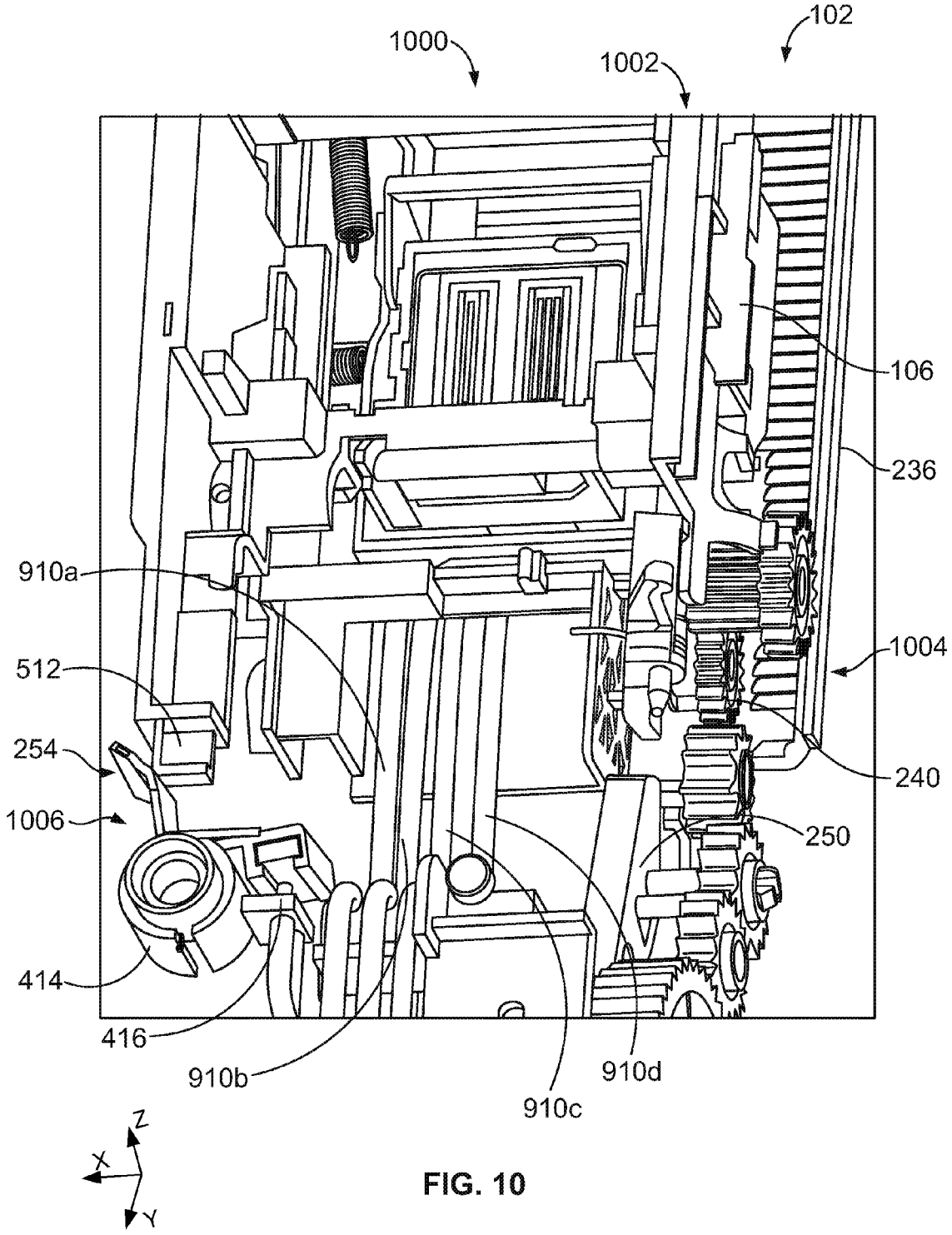
FIG. 10 depicts the example service station of FIG. 2 in a purging position.

FIG. 10 depicts the service station 102 in a purging position 1000 to enable a purging operation. In the purging position 1000, the carriage 106 is moved to a carriage purging position 1002 between the home position 126 and the priming position 902 (e.g., a distance of 9 millimeters away from the home position 126 in a direction toward the print zone 108). In the carriage purging position 1002, the first leg 510 of the carriage 106 is positioned away from the arm 244 to move the shuttle clutch 240 to a disengaged position 1004, but the second leg 512 engages the vent valve 416 to move the vent valve 416 to an open position 1006 between the fully open position 508 and the closed position 414. Thus, in the purging position 1000, the shuttle drive 236 is decoupled from the printer drive 132, but the pump 248 is operatively coupled to the printer drive 132 via the pump clutch 250 and the pump drive assembly 234 because the shuttle 210 is in the fully extended position. During a purging operation, air and/or fluid (e.g., ink) within priming tubes 910*a* and 910*d* can be evacuated, cleared or expelled to the absorbers 256 (FIG. 2). For example, when the vent 414 is in the open position 1006 while the pump 248 is driven, the tubing 910*b* and 910*c* allow air flow from the atmosphere into the cap sled 208 to purge excess ink in the tubing 910*a* and 910*d* down prime holes (not shown) and to the absorbers 256.

Thus, the opening and closing of the carriage-actuated venting system 252 allows the printhead assembly 104 to be primed when the vent system 252 is in a closed position and allows ink or fluid to be removed from the priming tubes 910*a* and 910*d* when the venting system 252 is in an open position. In this manner, the vent system 252 through tubing 910*b* and 910*c* maintains a substantially unobstructed or clear air flow path while the printhead assembly 104 is capped during periods of non-use.

Figure 11A:
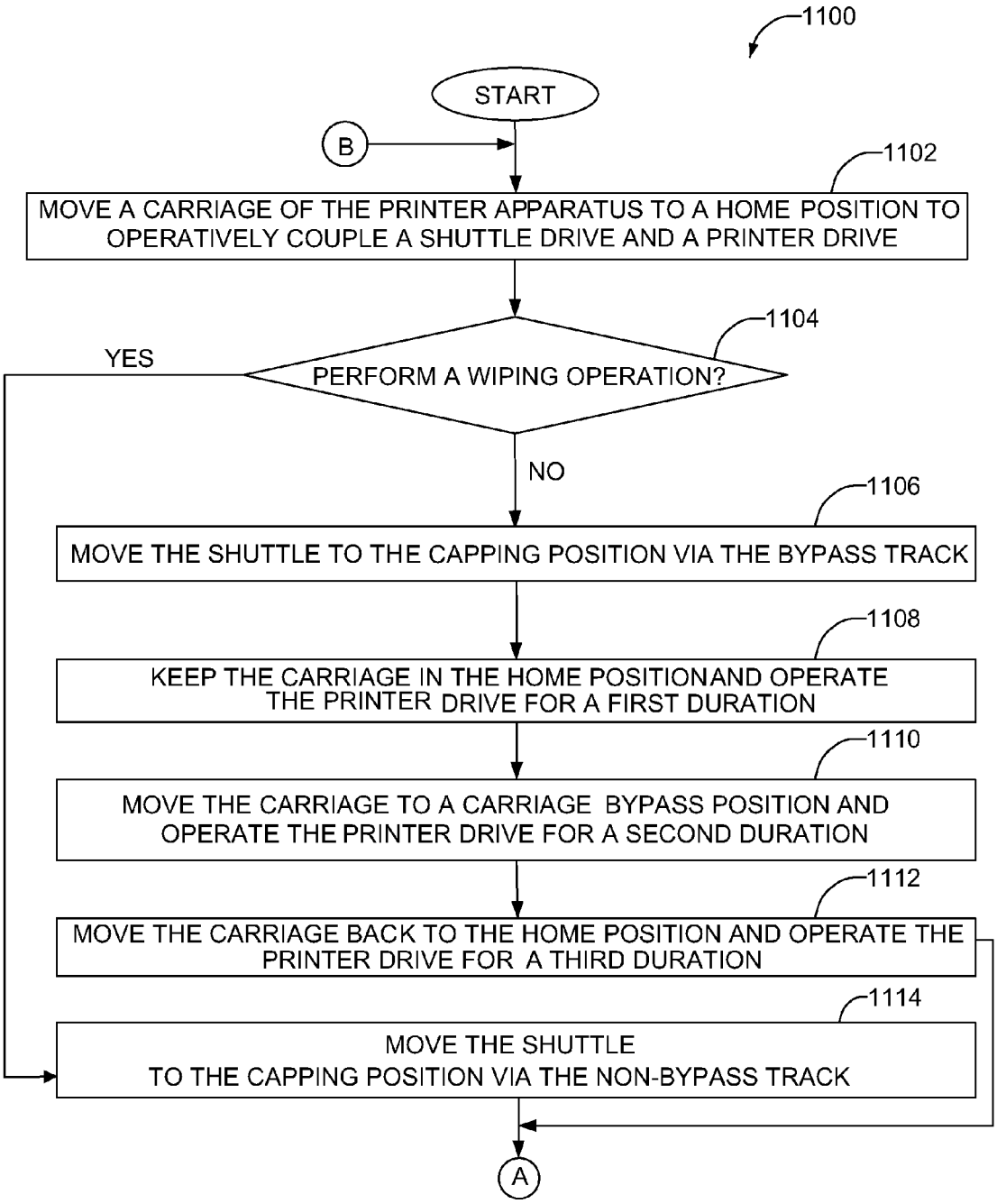
FIGS. 11A and 11B illustrate a flowchart representative of an example process that may be carried to position the carriage relative to the example service station described herein.
Figure 11B:
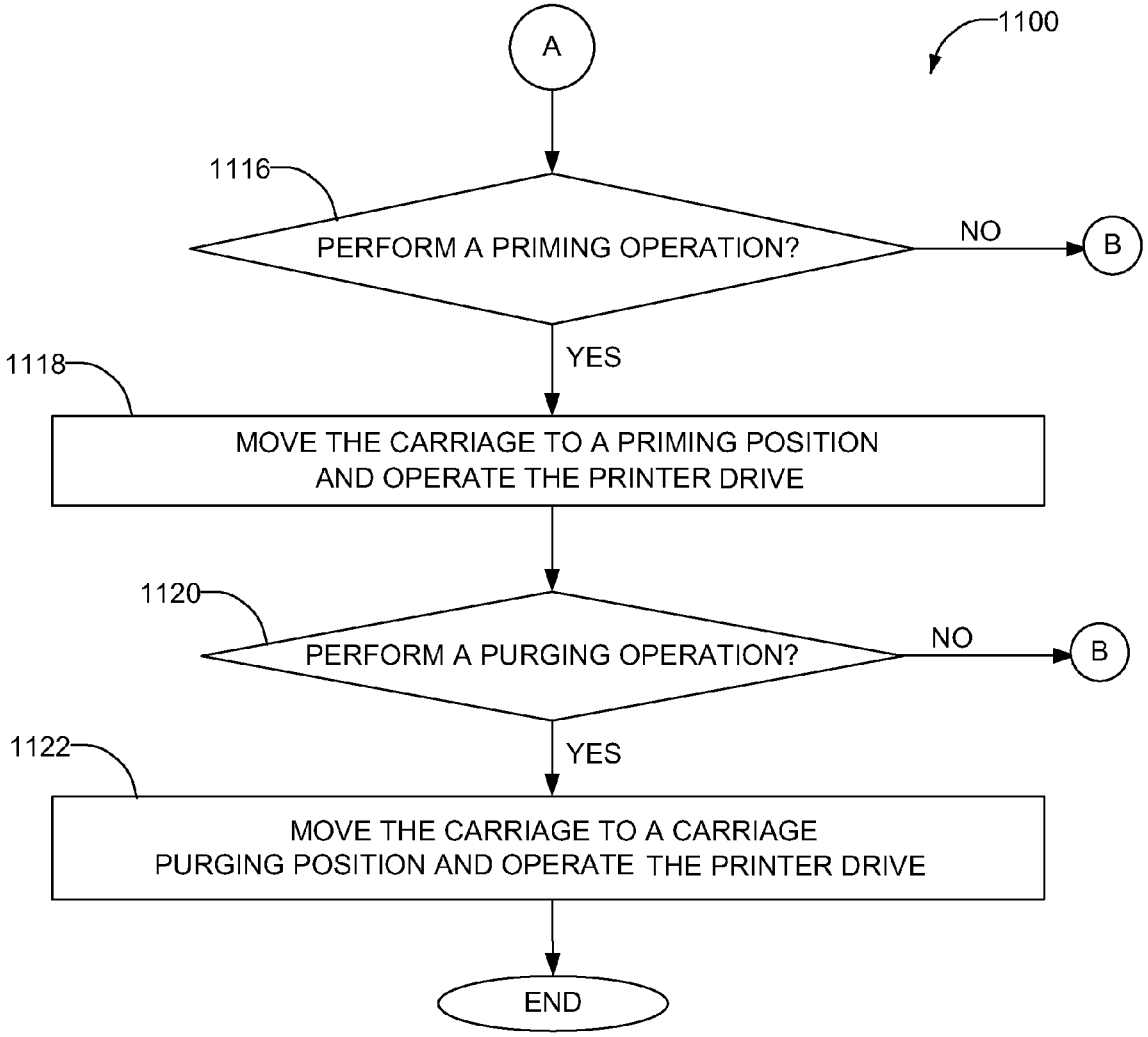

FIGS. 11A and 11B illustrate a flow diagram illustrating an example process that can be carried out by machine readable instructions 1100, which may be executed to operate or activate the service station 102 describe herein. While an example process 1100 has been illustrated in FIGS. 11A and 11B, one or more of the operations illustrated in FIGS. 11A and 11B may be combined, divided, re-arranged, omitted, eliminated and/or implemented in any other way. Further still, the example process 1100 of FIGS. 11A and 11B may include one or more operations and/or steps in addition to, or instead of, those illustrated in FIGS. 11A and 11B, and/or may include more than one of any or all of the illustrated processes and/or steps. Further, although the example process 1100 is described with reference to the flow chart illustrated in FIGS. 11A and 11B, many other methods of activating or operating the service station 102 described herein may alternatively be used.

Referring to FIGS. 11A and 11B, the carriage 106 of the printer apparatus 100 is moved to the home position 126 to operatively couple the shuttle drive 236 and the printer drive 132 (block 1102).

The process 1100 then determines whether to perform a wiping operation (block 1104). If a wiping operation is necessary, then the shuttle 210 is driven to the capping position 802 via the non-bypass track 608 of the shuttle drive 236 (block 1114). For example, the process 1100 keeps the carriage 106 in the home position 126 so that the clutch gear 246 drives along the non-bypass track 608 between the first and second ends 236*a*, 236*b*.

If the process 1100 determines that a wiping operation is not required at block 1104, the process 1100 the shuttle 210 is driven to the capping position 802 via the bypass track 612 of the shuttle drive 236 (block 1106).

To drive the shuttle to the capping position 802 via the bypass track 612, the process 1100 keeps the carriage 106 in the home position 126 and drives printer drive 132 for a first duration associated with the distance between adjacent the end 238*b* of the shuttle 210 and the second plurality of gear teeth 604 (block 1108). As the clutch gear 246 approaches the second plurality of gear teeth 604, the process 1100 moves the carriage 106 to the carriage bypass position 614 and drives the printer drive 132 for a second duration associated with the distance of the bypass track 612 (block 1110). As the clutch gear 246 approaches the end 618 of the bypass track 612, the process 1100 causes the carriage 106 to move back to the home position 126 and drives the printer drive 132 for a third duration associated with the distance between the end 618 of the second plurality of gear teeth 604 and the end 238*a* of the shuttle drive 236 (block 1112).

The process 1100 then determines whether to perform a priming operation (block 1116). If a priming operation is not required, then the process 1100 keeps the service station 102 in the capping position 802. If a priming operation is required, then the process 1100 moves the carriage to the priming position 906 and drives the printer drive 132 (block 1118).

The process 1100 then determines whether to perform a purging operation (block 1120). If a purging operation is not required, then the system 1100 keeps the service station 102 in the capping position 802. If a purging operation is required, then the process 1100 moves the carriage 106 to the purging position 1002 and drives the printer drive 132 (block 1122).

Figure 12:
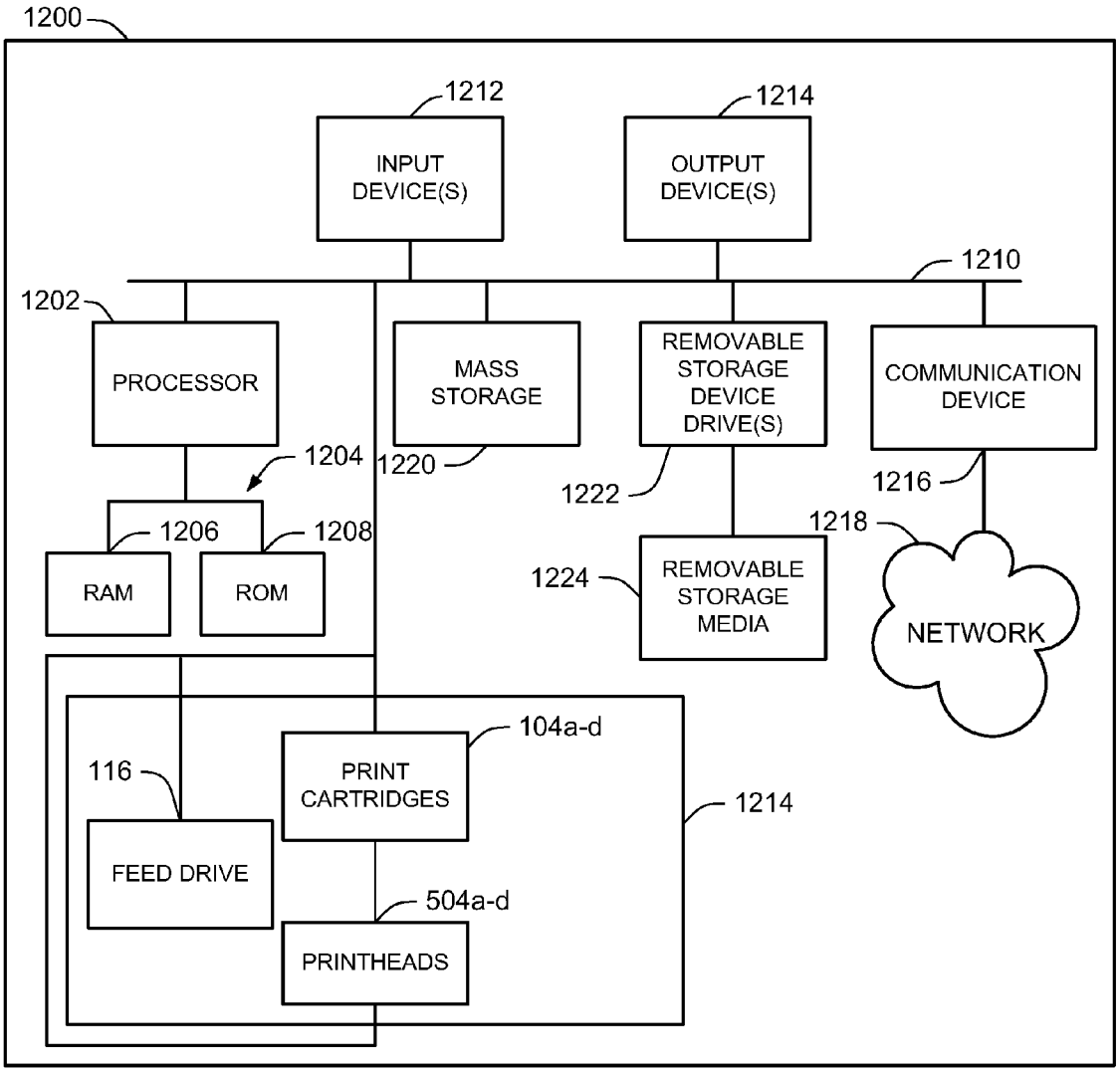
FIG. 12 is a block diagram of an example machine capable that may be used to implement the example methods and apparatus described herein.

FIG. 12 is a is a block diagram of an example machine capable of performing process of FIGS. 11A and 11B to implement the service station of FIGS. 1, 2, 3A, 3B, 4, 5, 6A-6D and 7-10.

The control platform can be, for example, a controller for a printer or other image forming apparatus and/or any other type of processing or controller platform to execute printing commands. The control platform of the instant example includes a processor 1202. For example, the processor 1202 can be implemented by one or more microprocessors, embedded microcontrollers, system on a chip (SoC), and/or any other type of processing, arithmetic, and/or logical unit.

The processor 1202 is in communication with a main memory 1204 including a volatile memory 1206 and a non-volatile memory 1208. The volatile memory 1206 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1208 may be implemented by read-only memory (ROM), flash memory, and/or any other desired type of memory device. Access to the main memory 1204 is typically controlled by a memory controller (not shown).

The controller 1200 also includes an interface circuit, such as a bus 1210. The bus 1210 may be implemented by any type of interface standard, such as an Ethernet interface, a universal serial bus (USB), and/or a PCI express interface.

Input device(s) 1212 are connected to the bus 1210. The input device(s) 1212 permit a user to enter data and commands into the processor 1202. The input device(s) 1212 can be implemented by, for example, a keyboard, a programmable keypad, a mouse, a touchscreen, a track-pad, a trackball, isopoint, and/or a voice recognition system.

Output device(s) 1214 are also connected to the bus 1210. The example output device(s) 1214 of FIG. 12 are implemented, for example, by display devices (e.g., a liquid crystal display, a cathode ray tube display (CRT), and/or speakers) and printer devices (e.g., print head(s), substrate path control, aerosol control, etc.). In particular, the processor 1202 of the illustrated example provides commands to the example printhead assembly 104 via the bus 1210. The processor 1202 of the illustrated example provides commands to the carriage 106 of FIG. 1 to position carriage 106 relative to the scan axis 118. For example, the processor 1202 commands the carriage 106 to the home position 126, the carriage bypass position 616, the carriage priming position 902, and/or the carriage purging position 1002. The example processor 1202 of FIG. 12 further provides instructions or a signal to an excitation source (e.g., a thermal resistor) of the printhead assembly 104 of FIG. 1 via the bus 1210 in order to generate ink droplets for forming an image on a print substrate. The output device(s) 1214 of FIG. 12 may additionally or alternatively include, for example, the feed drive 116 or substrate advancement device(s) to advance a media through the print zone 108. In some examples the bus 1210 includes a graphics driver card to output graphics on a display device.

The example bus 1210 also includes a communication device 1216 such as a wired or wireless network interface card to facilitate exchange of data (e.g., images to be formed on a substrate) with external computers via a network 1218.

The example controller 1200 of FIG. 12 further includes mass storage device(s) 1220 and removable storage drive(s) 1222 for storing software and data. Machine readable removable storage media 1224 may be inserted into the removable storage drive 1222 to allow the removable storage drive 1222 to provide the instructions contained on the media 1224 to, for example, the processor 1202. Examples of such mass storage devices 820 and/or computer readable media include floppy disks, hard drive disks, compact discs (CDs), digital versatile discs (DVDs), memory cards, Universal Serial Bus (USB) storage drives, and/or any other articles of manufacture and/or machine readable media capable of storing machine readable coded instructions to implement the process 1100 of FIGS. 11A and 11B. Accordingly, coded instructions may be stored in the removable storage media 1224, the mass storage device 1220, in the volatile memory 1206, and/or in the non-volatile memory 1208.

The foregoing description, therefore, should not be construed to limit the scope of the disclosure, which is defined in the claims that follow the description.

The example methods and apparatus described above were developed in an effort to improve the performance of service station of in fluid ejection system such as an inkjet printer and to reduce the overall dimensional platform of a fluid ejection system and/or the costs associated with manufacturing the fluid ejection system. Thus, embodiments of the disclosure are described with reference to a service station for a fluid ejection system. As noted at the beginning of this Description, the examples shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A service station for use with a printer comprising:

a shuttle to support a cap sled, the shuttle having a shuttle drive positioned on a first side of the shuttle, the shuttle drive including a track; and a pump drive positioned adjacent the track and the first side of the shuttle such that the shuttle drive and the pump drive do not extend between the first side of the shuttle and a second side of the shuttle opposite the first side, the shuttle drive to be coupled to a printer drive to move the shuttle between a first position and a second position.

2. A service station as defined in claim 1, wherein the shuttle includes an actuator to selectively couple the pump drive to the printer drive when the shuttle is in the second position.

3. A service station as defined in claim 1, wherein the shuttle drive includes a shuttle clutch to selectively couple the shuttle to the printer drive.

4. A service station as defined in claim 3, wherein a carriage of the printer is to engage an arm of the shuttle clutch to move the shuttle clutch to an engaged position and the carriage is to release the arm of the shuttle clutch to move the shuttle clutch to a disengaged position.

5. A service station as defined in claim 4, wherein the track of the shuttle drive is to be engaged by the shuttle clutch when the carriage moves the shuttle clutch to the engaged position.

6. A service station as defined in claim 5, wherein the track comprises a rack gear having a first plurality of gear teeth and a second plurality of gear teeth, the first plurality of gear teeth being different than the second plurality of gear teeth.

7. A service station as defined in claim 6, wherein the first plurality of gear teeth has a width that is less than half the width of the second plurality of gear teeth.

8. A service station as defined in claim 1, wherein the service station further comprises an absorber disposed adjacent the second side of the shuttle.

9. A service station as defined in claim 1, wherein the shuttle drive and the pump drive are arranged in-line relative to the track of the shuttle drive along which the shuttle is to move and are operatively coupled to the printer drive via a gear train.

10. A method for operating a service station for use with a printer comprising:

moving a shuttle supporting a cap sled, the shuttle having a shuttle drive positioned on a first side of the shuttle, a pump drive positioned adjacent a track of the shuttle drive and the first side of the shuttle such that the shuttle drive and the pump drive do not extend between the first side of the shuttle and a second side of the shuttle opposite the first side; and moving, via a coupling with a printer drive, the shuttle drive to move the shuttle between a first position and a second position.

11. A method of claim 10, further comprising selectively coupling the pump drive to the printer drive via an actuator of the shuttle when the shuttle is in the second position.

12. A method of claim 10, further comprising selectively coupling the shuttle to the printer drive via a shuttle clutch of the shuttle drive.

13. A method of claim 12, further comprising engaging an arm of the shuttle clutch via a carriage of the printer to move the shuttle clutch to an engaged position, and moving the shuttle clutch to a disengaged position by causing the carriage to release the arm of the shuttle clutch.

14. A method of claim 13, further comprising causing the shuttle clutch to engage the track of the shuttle drive when the carriage moves the shuttle clutch to the engaged position.

15. A method of claim 14, further comprising causing the shuttle clutch to engage a rack gear of the track having a first plurality of gear teeth and a second plurality of gear teeth, the first plurality of gear teeth being different than the second plurality of gear teeth.

16. A method of claim 15, further comprising providing the first plurality of gear teeth having a width that is less than half the width of the second plurality of gear teeth.

17. A method of claim 10, further comprising providing an absorber adjacent the second side of the shuttle.

18. A method of claim 10, further comprising arranging the shuttle drive and the pump drive in-line relative to the track of the shuttle drive along which the shuttle is to move.

19. A method of claim 18, further comprising operatively coupling the shuttle drive and the pump drive to the printer drive via a gear train.

20. A service station for use with a printer comprising:

a shuttle to support a cap sled, the shuttle including a shuttle drive having a track positioned on a first side of the shuttle; and a pump drive positioned adjacent the track and the first side of the shuttle such that the shuttle drive and the pump drive do not extend between the first side of the shuttle and a second side of the shuttle opposite the first side, the shuttle drive to be coupled to a printer drive to move the shuttle between a first position and a second position, the shuttle drive and the pump drive being arranged in-line relative to the track of the shuttle drive along which the shuttle is to move and are operatively coupled to the printer drive via a gear.

21. A service station as defined in claim 20, wherein the shuttle includes an actuator to selectively couple the pump drive to the printer drive when the shuttle is in the second position.

22. A service station as defined in claim 3, wherein the shuttle clutch comprises a lever and a shuttle clutch gear, the lever to cause the clutch gear to move relative to the track to enable the clutch gear to engage the track and to disengage the track.

23. A service station as defined in claim 22, wherein the shuttle drive comprises a shuttle cluster drive gear in mesh with a power take-off gear of the printer drive.

24. A service station as defined in claim 23, wherein the shuttle drive further comprises a pump cluster gear in mesh with the shuttle cluster gear, and a transition gear in mesh with the shuttle cluster gear, wherein the shuttle cluster gear, the pump cluster gear and the transition gear remain operatively coupled to the power take-off gear during operation of the printer.

25. A service station as defined in claim 24, wherein the shuttle clutch gear is to engage the shuttle cluster gear when the shuttle clutch gear is enmeshed with the track.

26. A service station as defined in claim 25, wherein the pump drive comprises a pump clutch to selectively couple and decouple a pump to the printer drive via the shuttle drive.

27. A service station as defined in claim 26, wherein the pump clutch comprises a lever and a pump clutch gear that are pivotally coupled relative to the shuttle about a pump clutch axis that is non-parallel relative to a longitudinal axis of the track.

28. A service station as defined in claim 27, wherein the pump clutch gear selectively engages and disengages the transition gear to operatively couple and decouple the pump and the printer drive via the shuttle cluster gear and the pump cluster gear of the shuttle drive.

29. A service station as defined in claim 28, wherein the shuttle includes an actuator to actuate the pump clutch, the actuator being adjacent a first end of the track.

30. A service station as defined in claim 29, wherein the actuator comprises a raised lip portion or protrusion extending from a bearing surface of the shuttle.

31. A service station as defined in claim 30, wherein the actuator engages the lever of the pump clutch to operatively couple the pump clutch gear and the transition gear and the actuator disengages the lever of the pump clutch to operatively decouple the pump clutch gear and the transition gear.

32. A service station as defined in claim 1, wherein the shuttle drive and the pump drive do not span an area underneath the shuttle.

33. A service station as defined in claim 1, wherein the shuttle drive and the pump drive are located on a same side of the shuttle.

34. A service station as defined in claim 1, wherein no portions of the shuttle drive, the pump drive and the printer drive extend across the first side of the shuttle and the second side of the shuttle.

* * * * *